US011621517B2

(12) United States Patent
Nakazawa

(10) Patent No.: US 11,621,517 B2
(45) Date of Patent: Apr. 4, 2023

(54) CONNECTING APPARATUS

(71) Applicant: JAPAN AVIATION ELECTRONICS INDUSTRY, LIMITED, Tokyo (JP)

(72) Inventor: Katsuhiko Nakazawa, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 178 days.

(21) Appl. No.: 17/289,005

(22) PCT Filed: Sep. 30, 2019

(86) PCT No.: PCT/JP2019/038580
§ 371 (c)(1),
(2) Date: Apr. 27, 2021

(87) PCT Pub. No.: WO2020/137064
PCT Pub. Date: Jul. 2, 2020

(65) Prior Publication Data

US 2021/0408722 A1 Dec. 30, 2021

(30) Foreign Application Priority Data

Dec. 27, 2018 (JP) ..... JP2018-244577

(51) Int. Cl.
*H01R 13/639* (2006.01)
*H01R 13/52* (2006.01)
*H01R 31/06* (2006.01)

(52) U.S. Cl.
CPC ..... *H01R 13/5213* (2013.01); *H01R 13/639* (2013.01); *H01R 31/06* (2013.01)

(58) Field of Classification Search
CPC .. H01R 13/5213; H01R 13/639; H01R 31/06; H01R 24/60; H01R 12/00; H01R 24/28; H01R 31/08; H01R 31/085
See application file for complete search history.

(56) References Cited

U.S. PATENT DOCUMENTS 6,447,331 B1 * 9/2002 Fukatsu ..... H01R 31/08 439/511
7,172,472 B2 * 2/2007 Fujii ..... H01R 43/16 439/869

(Continued)

FOREIGN PATENT DOCUMENTS

JP H05-087836 U 11/1993
JP H07-073938 A 3/1995

(Continued)

OTHER PUBLICATIONS

Chinese Office Action dated Aug. 2, 2022 in CN 201980076149.9 with machine translation.

(Continued)

*Primary Examiner* — Tho D Ta
(74) *Attorney, Agent, or Firm* — Collard & Roe, P.C.

(57) ABSTRACT

A connecting apparatus comprising a holding member and a conductive member. The holding member has holding portions. The conductive member has a plurality of held portions, a plurality of contact portions, a plurality of extending portions and a plurality of coupling portions. Each of the extending portions extends rearward in a front-rear direction from one of the held portions and protrudes rearward in the front-rear direction beyond the holding portion. The extending portions are positioned apart from each other in a right-left direction. The coupling portions are positioned apart from each other in the right-left direction. The coupling portions are positioned rearward of the extending portions in the front-rear direction. Each of the coupling portions couples two of the extending portions with each other. Two of the held portions, which are adjacent to each other in the right-left direction, are coupled with the two extending portions, respectively.

10 Claims, 11 Drawing Sheets

(56) References Cited

U.S. PATENT DOCUMENTS

| | | | | |
|---|---|---|---|---|
| 7,175,489 | B2 | 2/2007 | Fujii et al. | |
| 7,241,168 | B2 * | 7/2007 | Sakurai | H01R 31/085 439/511 |
| 9,011,189 | B2 * | 4/2015 | Tsukamoto | H01R 43/16 439/885 |
| 9,211,852 | B2 | 12/2015 | Omori et al. | |

FOREIGN PATENT DOCUMENTS

| | | | |
|---|---|---|---|
| JP | H07-230864 | A | 8/1995 |
| JP | 2000-348838 | A | 12/2000 |
| JP | 2002-117950 | A | 4/2002 |
| JP | 2002-260752 | A | 9/2002 |
| JP | 2005-116472 | A | 4/2005 |
| JP | 2014-232584 | A | 12/2014 |
| JP | 2016-167404 | A | 9/2016 |
| WO | 2013/042576 | A | 3/2013 |

OTHER PUBLICATIONS

International Search Report in PCT/JP2019/038580, dated Nov. 5, 2019.

* cited by examiner

CONNECTING APPARATUS

CROSS REFERENCE TO RELATED APPLICATIONS

This application is the National Stage of PCT/JP2019/038580 filed on Sep. 30, 2019, which claims priority under 35 U.S.C. § 119 of Japanese Application No. 2018-244577 filed on Dec. 27, 2018, the disclosure of which is incorporated by reference. The international application under PCT article 21(2) was not published in English.

TECHNICAL FIELD

The present invention relates to a connecting apparatus for electrically connecting predetermined ones of a plurality of mating terminals to each other.

BACKGROUND ART

Patent Document 1 discloses a connecting apparatus 900 of this type. Referring to FIGS. 21 and 22, the connecting apparatus 900 of Patent Document 1 comprises a holding member 910 and a conductive member 950. The holding member 910 has holding portions 912. The holding portions 912 are provided with a plurality of exposed holes 9122. The exposed hole 9122 pierces a part of the holding portion 912 in a Z-direction. The conductive member 950 has a plurality of held portions 952, a plurality of contact portions 954 and a plurality of coupling portions 956. The held portions 952 are held by the holding portions 912, respectively. The held portions 952 are arranged in a Y-direction. The contact portion 954 is a portion which is configured to be brought into direct contact with a mating terminal (not shown). The contact portions 954 extend in a positive X-direction from the held portions 952, respectively. Each of the coupling portions 956 couples the held portions 952 which are adjacent to each other in the Y-direction. The coupling portions 956 correspond to the exposed holes 9122, respectively. Each of the coupling portions 956 is partially exposed in the exposed hole 9122 corresponding thereto. In order that electrical continuity of a specific one(s) of the coupling portions 956 is broken while predetermined ones of the mating terminals (not shown) are electrically connected to each other, the specific coupling portion 956 is partially removed via the exposed hole 9122 corresponding thereto by using a press pin 970 and a receiving jig 980.

PRIOR ART DOCUMENTS

Patent Document(s)

Patent Document 1: JPA H7-230864

SUMMARY OF INVENTION

Technical Problem

The connecting apparatus 900 of Patent Document 1 requires special tools such as the press pin 970 and the receiving jig 980 for removing a part(s), whose electrical continuity is intended to be broken, of the conductive member 950.

It is therefore an object of the present invention to provide a connecting apparatus comprising a conductive member which enables a user to modify its part(s), whose electrical continuity is intended to be broken, without using any special tool.

Solution to Problem

An aspect of the present invention provides a connecting apparatus comprising a holding member and a conductive member. The conductive member is held by the holding member. The holding member has holding portions. The conductive member has a plurality of held portions, a plurality of contact portions, a plurality of extending portions and a plurality of coupling portions. The held portions are held by the holding portions, respectively, and are arranged in a right-left direction. The contact portions correspond to the held portions, respectively. Each of the contact portions is positioned forward of the corresponding held portion in a front-rear direction perpendicular to the right-left direction. Each of the extending portions extends rearward in the front-rear direction from one of the held portions and protrudes rearward in the front-rear direction beyond the holding portion. The extending portions are positioned apart from each other in the right-left direction. The coupling portions are positioned apart from each other in the right-left direction. The coupling portions are positioned rearward of the extending portions in the front-rear direction. Each of the coupling portions couples two of the extending portions with each other. Two of the held portions, which are adjacent to each other in the right-left direction, are coupled with the two extending portions, respectively.

Advantageous Effects of Invention

In the connecting apparatus of the present invention, each of the extending portions extends rearward from one of the held portions and protrudes rearward beyond the holding portion of the holding member. The coupling portions are positioned apart from each other in the right-left direction. Each of the coupling portions couples two of the extending portions with each other. Two of the held portions, which are adjacent to each other in the right-left direction, are coupled with the two extending portions, respectively. Accordingly, if a user intends to remove a specific one of the coupling portions, the user splits each of the extending portions, which are coupled by the specific coupling portion, into two parts which are separated from each other in the front-rear direction. The splitting of the extending portions enables the user to selectively remove the specific coupling portion. Upon the removal of the coupling portion, the user can directly split the extending portions or can apply a force to the coupling portion to snap off the extending portions coupled thereby. The splitting of the extending portions and the snapping-off of the extending portions are relatively easily achieved by using a conventional tool.

An appreciation of the objectives of the present invention and a more complete understanding of its structure may be had by studying the following description of the preferred embodiment and by referring to the accompanying drawings.

DESCRIPTION OF EMBODIMENTS

Figure 1:
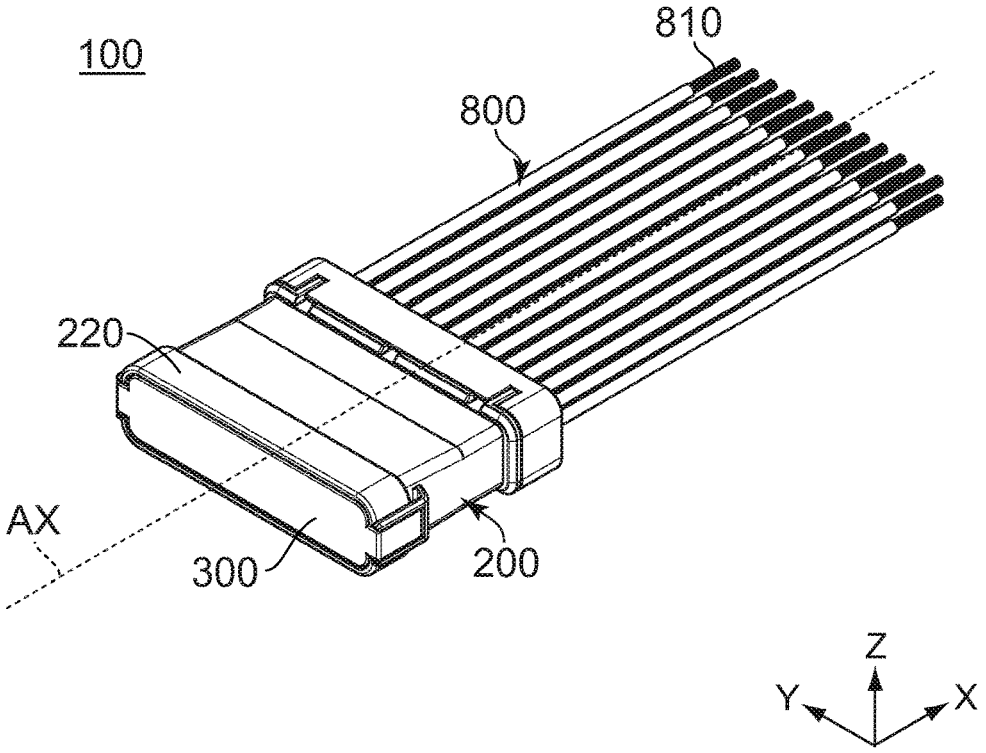
FIG. 1 is a perspective view showing a connecting apparatus according to a first embodiment of the present invention. In the figure, a cap is attached to a surrounding portion of a holding member.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

First Embodiment

Figure 3:
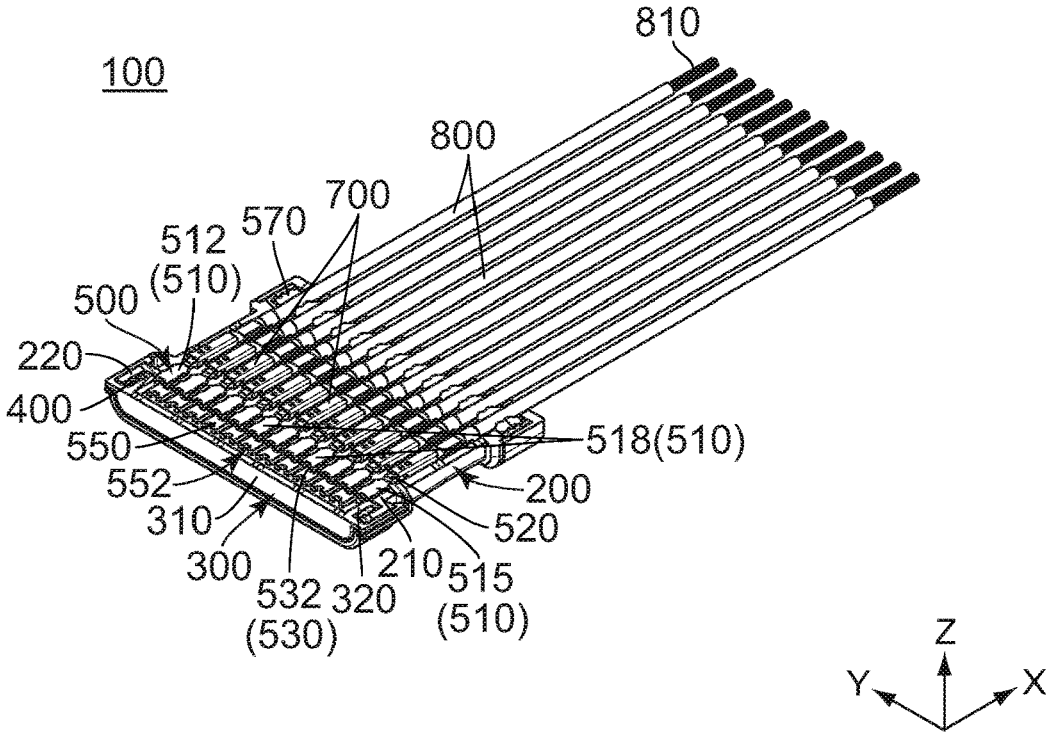
FIG. 3 is a partially cut-away, perspective view showing the connecting apparatus of FIG. 1.

As shown in FIG. 3, a connecting apparatus 100 according to a first embodiment of the present invention comprises a holding member 200, a conductive member 500, contact target portions 700 and a plurality of cables 800. The conductive member 500 is held by the holding member 200.

Figure 4:
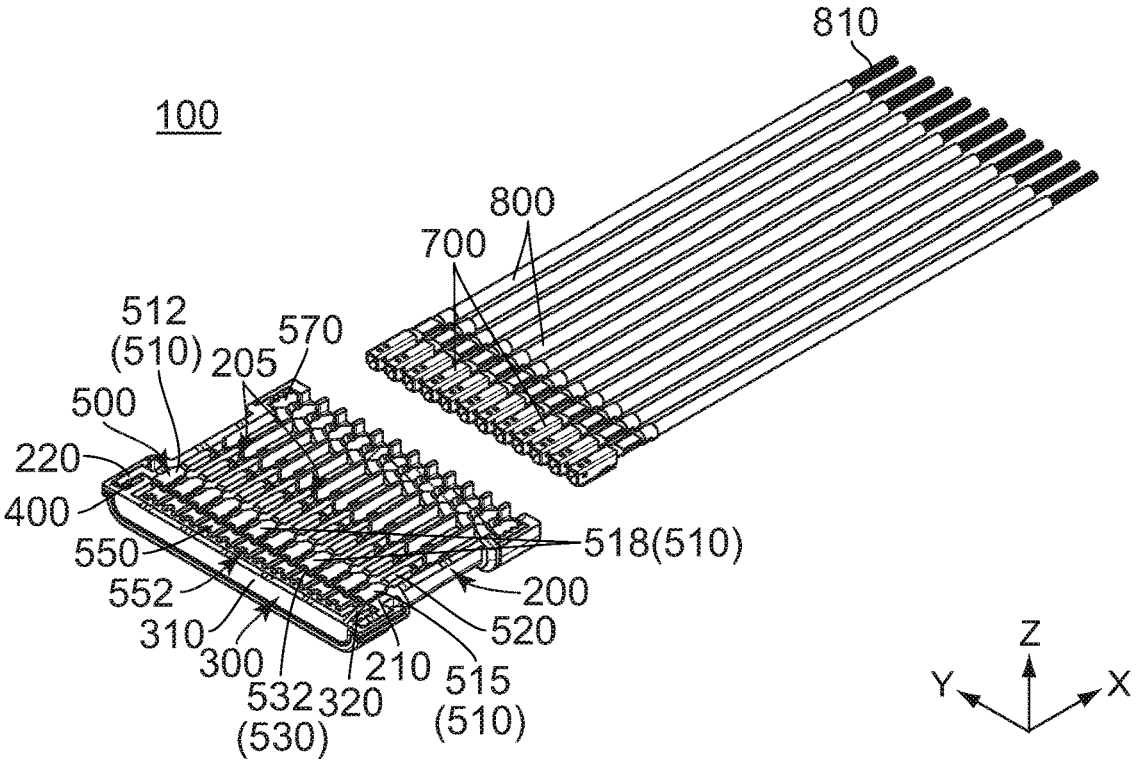
FIG. 4 is another partially cut-away, perspective view showing the connecting apparatus of FIG. 3. In the figure, contact target portions are not brought into contact with contact portions.

Referring to FIG. 4, the holding member 200 of the present embodiment is made of insulator. The holding member 200 has a plurality of accommodating holes 205 and a surrounding portion 220.

Figure 7:
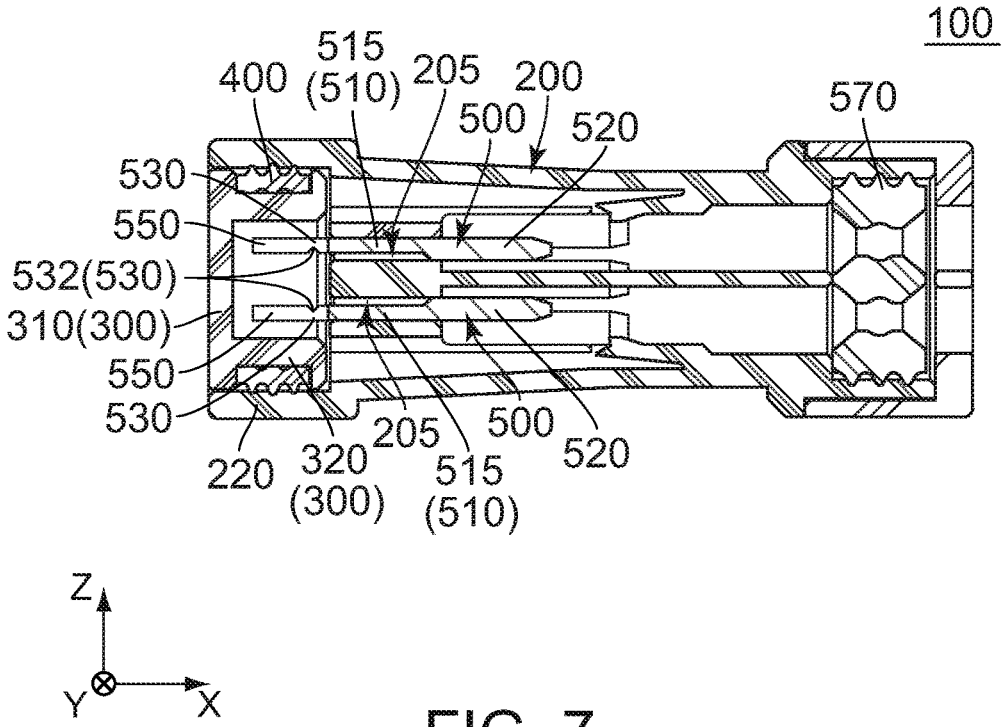
FIG. 7 is a cross-sectional view showing the connecting apparatus of FIG. 6, taken along line A-A.
Figure 8:
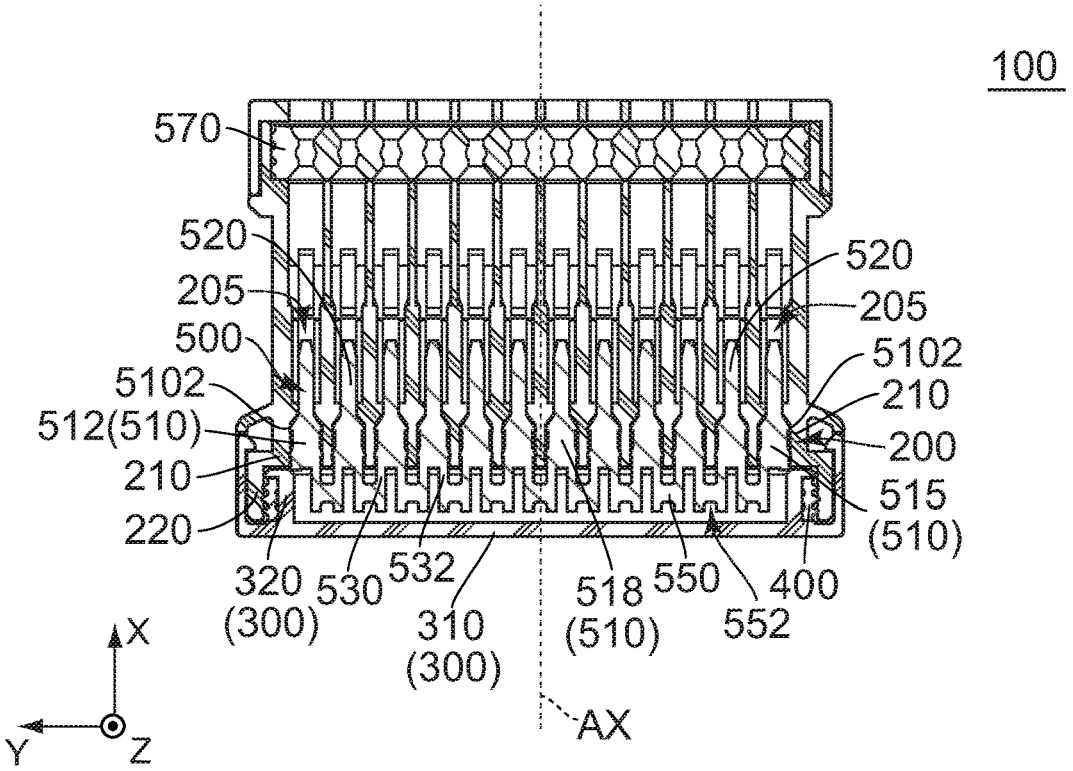
FIG. 8 is a cross-sectional view showing the connecting apparatus of FIG. 6, taken along line B-B.

As shown in FIGS. 7 and 8, each of the accommodating holes 205 of the present embodiment pierces the holding member 200 in a front-rear direction. Each of the accommodating holes 205 is positioned forward of the surrounding portion 220 in the front-rear direction. In the present embodiment, the front-rear direction is an X-direction. Specifically, it is assumed that forward is a positive X-direction while rearward is a negative X-direction. More specifically, the accommodating holes 205 are grouped into two rows which are arranged in an up-down direction. In the present embodiment, the up-down direction is a Z-direction. Specifically, it is assumed that upward is a positive Z-direction while downward is a negative Z-direction. The accommodating holes 205 of each row are arranged in a right-left direction. In the present embodiment, the right-left direction is a Y-direction. Specifically, it is assumed that rightward is a negative Y-direction while leftward is a positive Y-direction. The accommodating holes 205 are arranged so as to be rotationally symmetric about an axis AX extending in the front-rear direction.

As shown in FIG. 8, each of the accommodating holes 205 of the present embodiment has a holding portion 210. In other words, the holding member 200 of the present embodiment has the holding portions 210.

As shown in FIG. 8, the holding portion 210 of the present embodiment is a set of opposite inner surfaces of the accommodating hole 205 in the right-left direction. The holding portion 210 is positioned around a rear end of the accommodating hole 205 in the front-rear direction. The holding portion 210 is positioned forward of the surrounding portion 220 in the front-rear direction.

Figure 2:
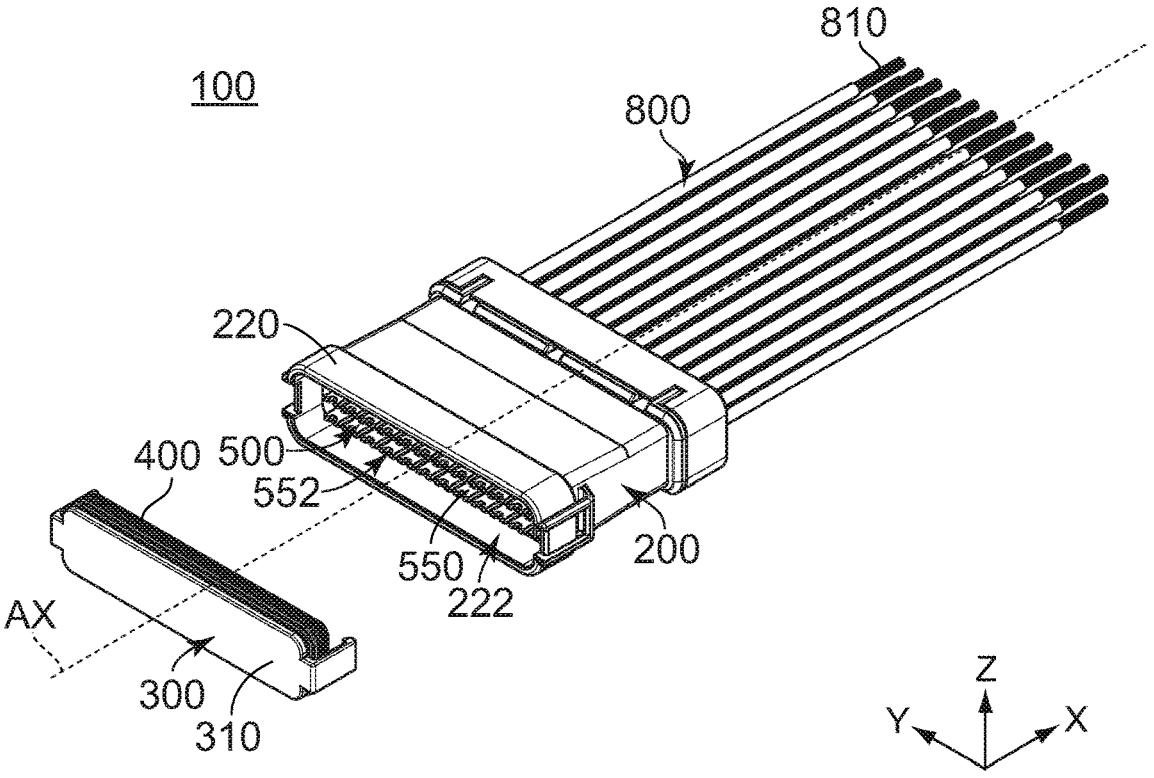
FIG. 2 is another perspective view showing the connecting apparatus of FIG. 1. In the figure, the cap is removed from the surrounding portion of the holding member.

As understood from FIGS. 2, 7 and 8, the surrounding portion 220 of the present embodiment extends in the front-rear direction. The surrounding portion 220 defines a rear end of the holding member 200. A rear end of the surrounding portion 220 is opened. In other words, the surrounding portion 220 has an opening 222 at its rear end. The surrounding portion 220 has a shape which is rotationally symmetric about the axis AX extending in the front-rear direction. The surrounding portion 220 has a substantially race track shape when viewed from its rear. In a perpendicular plane perpendicular to the front-rear direction, the surrounding portion 220 has the substantially race track shape which extends long in the right-left direction.

Figure 9:
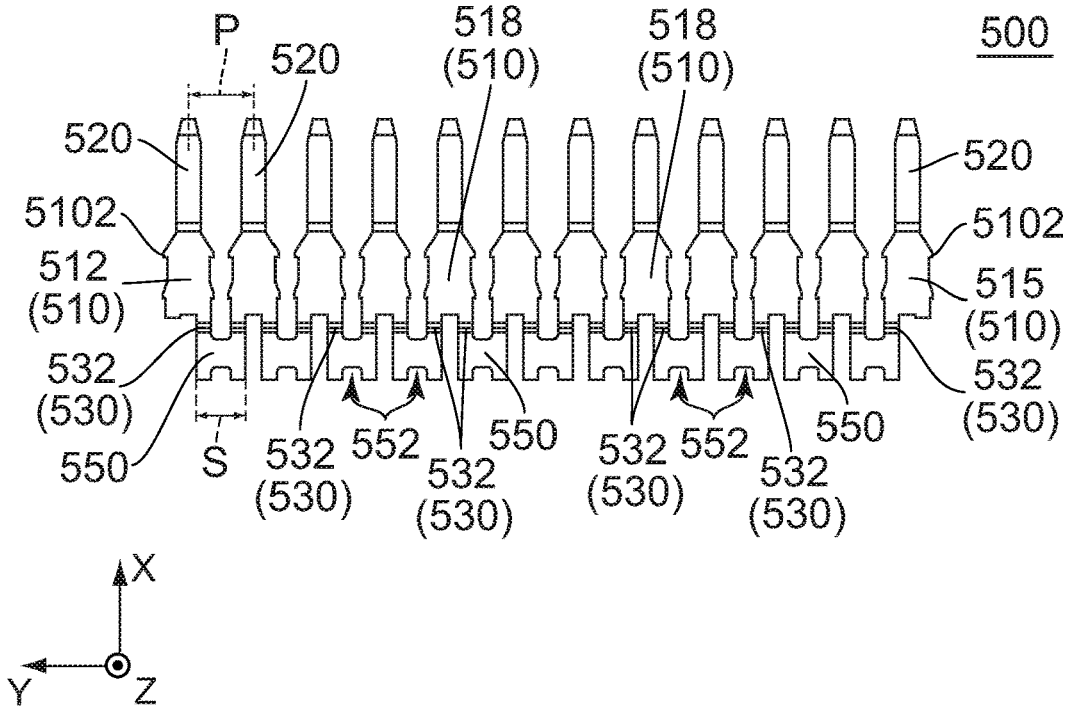
FIG. 9 is a top view showing a conductive member which is included in the connecting apparatus of FIG. 1.
Figure 10:
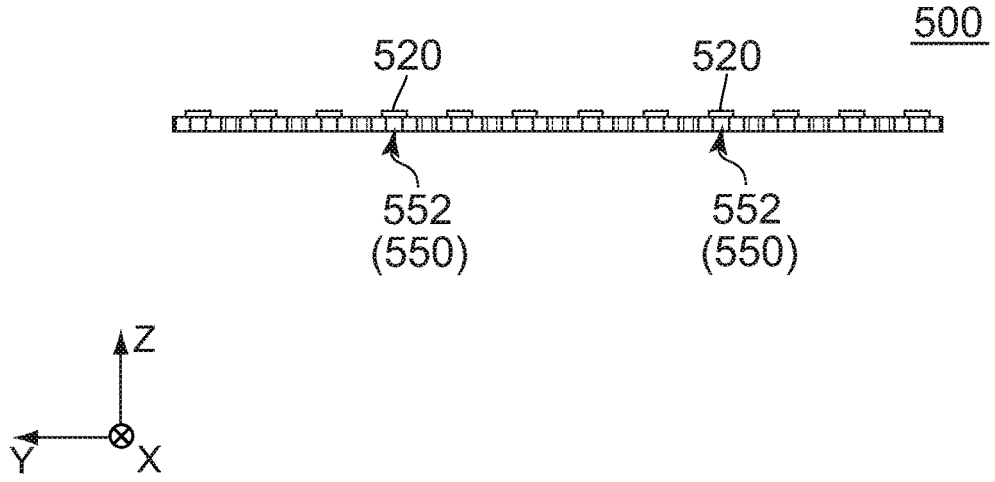
FIG. 10 is a rear view showing the conductive member of FIG. 9.

Referring to FIGS. 3 and 9, the conductive member 500 of the present embodiment is made of metal. The conductive member 500 has a plurality of held portions 510, a plurality of contact portions 520, a plurality of extending portions 530 and a plurality of coupling portions 550.

As shown in FIGS. 3 and 8, the held portions 510 of the present embodiment are held by the holding portions 210, respectively. The held portions 510 are arranged in the right-left direction. More specifically, the held portions 510 are grouped into two rows which are arranged in the up-down direction. The held portions 510 of each row are arranged in the right-left direction. The held portions 510 are arranged so as to be rotationally symmetric about the axis AX extending in the front-rear direction. The held portions 510 correspond to the accommodating holes 205, respectively, of the holding member 200. Each of the held portions 510 is press-fit into and accommodated in the accommodating hole 205 corresponding thereto.

As shown in FIG. 8, each of the held portions 510 of the present embodiment has press-fit protrusions 5102 each protruding outward in the right-left direction. The press-fit protrusion 5102 is press-fit into the holding portion 210 of the accommodating hole 205 of the holding member 200.

As shown in FIGS. 3 and 8, the held portions 510 include a rightmost held portion 515, a leftmost held portion 512 and at least one normal held portion 518. The rightmost held portion 515 is positioned at a rightmost end of the held portions 510 in the right-left direction. The leftmost held portion 512 is positioned at a leftmost end of the held portions 510 in the right-left direction. The normal held portion 518 is positioned between the rightmost held portion 515 and the leftmost held portion 512 in the right-left direction.

As shown in FIG. 9, the contact portions 520 of the present embodiment are arranged at pitches P in the right-left direction. The contact portions 520 correspond to the held portions 510, respectively. Each of the contact portions 520 is positioned forward of the held portion 510 corresponding thereto in the front-rear direction perpendicular to the right-left direction. The contact portion 520 of the present embodiment is a so-called pin contact (male contact). However, the present invention is not limited thereto. The contact portion 520 may be a socket contact (female contact).

As shown in FIG. 9, each of the extending portions 530 of the present embodiment extends rearward in the front-rear direction from one of the held portions 510 and protrudes rearward in the front-rear direction beyond the holding portion 210. Specifically, one of the extending portions 530 extends rearward in the front-rear direction from the rightmost held portion 515. One of the extending portions 530 extends rearward in the front-rear direction from the leftmost held portion 512. Two of the extending portions 530 extend rearward in the front-rear direction from the normal held portion 518. The extending portions 530 are positioned apart from each other in the right-left direction.

As understood from FIGS. 7 and 8, a part of each of the extending portions 530 is surrounded by the surrounding portion 220 in the perpendicular plane perpendicular to the front-rear direction. In the present embodiment, the perpendicular plane is a YZ-plane. More specifically, the part of each of the extending portions 530 is positioned in the surrounding portion 220. The part of each of the extending portions 530 is exposed in the surrounding portion 220.

As shown in FIG. 9, the extending portion 530 of the present embodiment is provided with a frangible portion 532 which has less strength. More specifically, the frangible portion 532 has the lowest strength in the extending portion 530. The frangible portion 532 has the strength lower than any of the held portion 510 and the coupling portion 550. The frangible portion 532 is a ditch extending in the right-left direction. However, the present invention is not limited thereto. The extending portion 530 may be modified, provided that a part of the extending portion 530 has a reduced cross-section perpendicular to the front-rear direction to function as the frangible portion 532.

As understood from FIGS. 7 and 8, the frangible portion 532 of the present embodiment is surrounded by the surrounding portion 220 in the perpendicular plane. More specifically, the frangible portion 532 is positioned in the surrounding portion 220. The frangible portion 532 is exposed in the surrounding portion 220.

As shown in FIG. 9, the coupling portions 550 of the present embodiment are positioned apart from each other in the right-left direction. The coupling portions 550 are positioned rearward of the extending portions 530 in the front-rear direction. Each of the coupling portions 550 couples two of the extending portions 530 with each other. Two of the held portions 510, which are adjacent to each other in the right-left direction, are coupled with the two extending portions 530, respectively. Each of the coupling portions 550 couples the extending portion 530, which extends from one of the two adjacent held portions 510 in the right-left direction, with the extending portion 530 which extends from a remaining one of the two adjacent held portions 510 in the right-left direction. The coupling portion 550 can be snapped off from the conductive member 500. More specifically, the coupling portion 550 is separable from the conductive member 500 by splitting each of the two extending portions 530 at the frangible portion 532 into two parts which are separated from each other in the front-rear direction.

As shown in FIG. 9, a size S of the coupling portion 550 is smaller than the pitch P between adjacent two of the contact portions 520. Accordingly, the coupling portions 550 are prevented from being brought into contact with each other.

As understood from FIGS. 7 and 8, each of the coupling portions 550 of the present embodiment is surrounded by the surrounding portion 220 in the perpendicular plane. More specifically, each of the coupling portions 550 is positioned in the surrounding portion 220. Each of the coupling portions 550 is exposed in the surrounding portion 220.

As shown in FIG. 9, each of the coupling portions 550 of the present embodiment has a concavity 552. The concavity 552 is positioned at a rear end of the coupling portion 550 in the front-rear direction. The concavity 552 is a recess which is opened rearward and is recessed forward. The concavity 552 is a portion to which a tool is configured to be hitched when the coupling portion 550 is snapped off. When a user intends to remove a specific one(s) of the coupling portions 550 from the conductive member 500, a user splits each of the two extending portions 530, which are coupled by the specific coupling portion 550, into two parts which are separated from each other in the front-rear direction. Since each of the coupling portions 550 has the concavity 552 as described above, a user can hitch a tool to the concavity 552 of the specific coupling portion 550 upon the splitting of the two extending portions 530 coupled by the specific coupling portion 550. This prevents a user from erroneously removing the coupling portion 550 which is adjacent to the specific coupling portions 550. In addition, a shape of the coupling portion 550 is not limited thereto. Specifically, the coupling portion 550 may have no concavity 552, or may have a shape different from the shape of the coupling portion 550 of the present embodiment. The coupling portion 550 can be snapped off from the conductive member 500 by using a conventional tool such as a needle-nose plier.

As shown in FIGS. 7 and 8, the surrounding portion 220 of the present embodiment surrounds the extending portions 530 and the coupling portions 550 in the plane perpendicular to the front-rear direction. In other words, the holding member 200 has the surrounding portion 220 which surrounds the extending portions 530 and the coupling portions 550 in the plane perpendicular to the front-rear direction.

Referring to FIG. 4, each of the contact target portions 700 of the present embodiment is made of metal. Each of the contact target portions 700 is a so-called socket contact (female contact). However, the present invention is not limited thereto. The contact target portion 700 may be a pin contact (male contact) if the contact portion 520 is a socket contact.

As shown in FIG. 3, the contact target portions 700 are held by the holding member 200. The contact target portion 700 is brought into physical and electrical contact with the contact portion 520 of the conductive member 500.

As shown in FIG. 3, the holding member 200 of the present embodiment holds the contact target portions 700 and the contact portions 520 of the conductive member 500 all together. Accordingly, the holding member 200 of the connecting apparatus 100 of the present embodiment has a seamless structure including a section, which holds the contact target portions 700, and another section which holds the contact portions 520. Thus, the connecting apparatus 100 of the present embodiment provides better waterproofing in comparison with an assumption where the contact target portions 700 be held by a part of a holding member 200 while the contact portions 520 be held by another part of a holding member 200 which is distinct and separated from the part.

As shown in FIG. 3, each of the cables 800 of the present embodiment extends in the front-rear direction. Each of the cables 800 has a core wire 810 made of metal. The vicinity of a rear end of the core wire 810 is physically and electrically connected with the contact target portion 700.

As shown in FIGS. 7 and 8, the connecting apparatus 100 of the present embodiment further comprises a cap 300, a first seal member (seal member) 400, and a second seal member 570.

Figure 5:
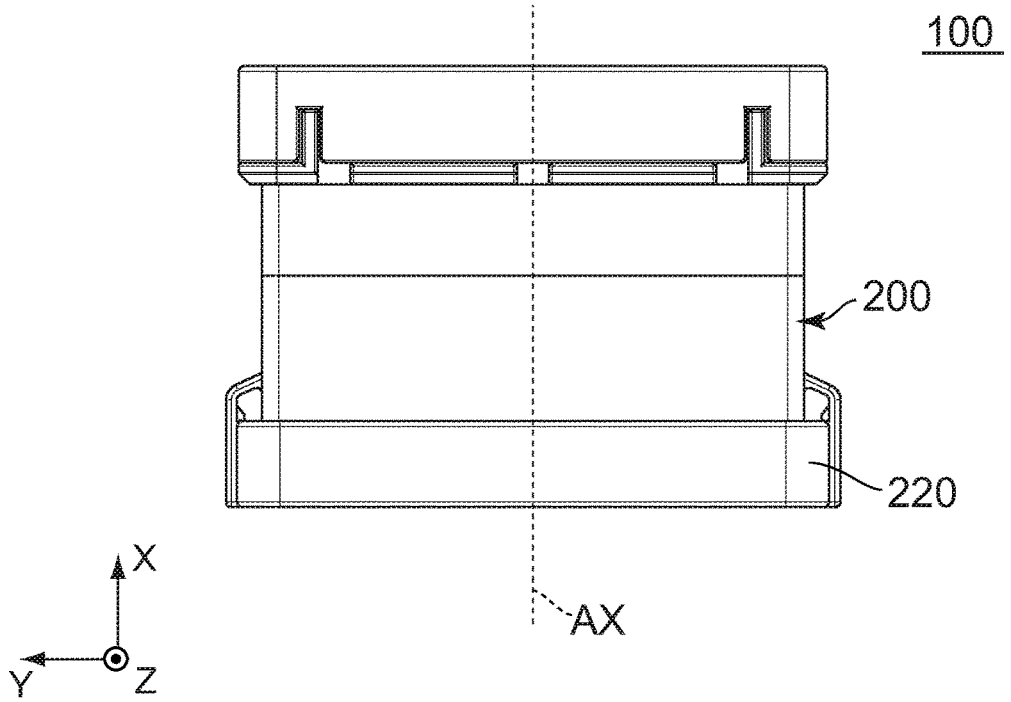
FIG. 5 is a top view showing the connecting apparatus of FIG. 1. In the figure, the contact target portions and cables are omitted.
Figure 6:
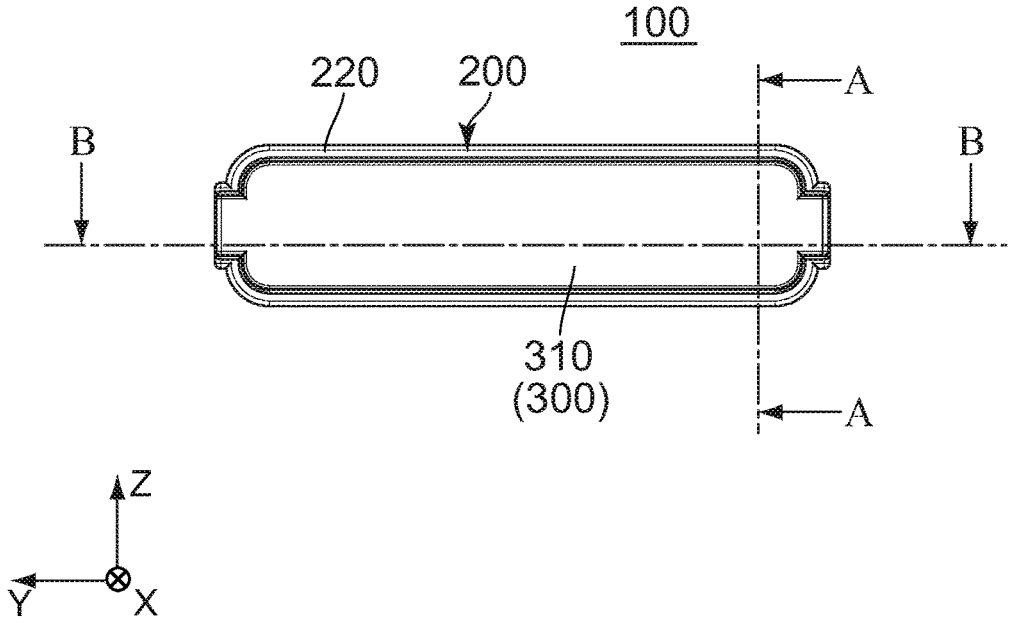
FIG. 6 is a rear view showing the connecting apparatus of FIG. 5.

As shown in FIGS. 5 and 6, the cap 300 of the present embodiment has a shape which is rotationally symmetric about the axis AX extending in the front-rear direction. As shown in FIGS. 7 and 8, the cap 300 is closed at its rear end and is opened at its front end. More specifically, the cap 300 has a rear surface 310 and a tube portion 320. The rear surface 310 defines the rear end of the cap 300. The tube portion 320 is positioned forward of the rear surface 310 in the front-rear direction. The tube portion 320 is coupled with a front end of the rear surface 310. The tube portion 320 has a substantially race track shape when viewed along the front-rear direction. In the perpendicular plane perpendicular to the front-rear direction, the tube portion 320 has the substantially race track shape which extends long in the right-left direction.

As shown in FIGS. 7 and 8, the cap 300 is attached to the surrounding portion 220. The cap 300 is positioned at a rear end of the connecting apparatus 100 in the front-rear direction. The cap 300 seals the opening 222 (see FIG. 2) of the surrounding portion 220.

As understood from FIGS. 7 and 8, a part of each of the extending portions 530 is surrounded by the tube portion 320 in the perpendicular plane under an attached state where the cap 300 is attached to the surrounding portion 220. More specifically, the part of each of the extending portions 530 is positioned in the tube portion 320 under the attached state. The part of each of the extending portions 530 is exposed in the tube portion 320 under the attached state.

As understood from FIGS. 7 and 8, each of the coupling portions 550 is surrounded by the tube portion 320 in the perpendicular plane under the attached state where the cap 300 is attached to the surrounding portion 220. More specifically, each of the coupling portions 550 is positioned in the tube portion 320 under the attached state. Each of the coupling portions 550 is exposed in the tube portion 320 under the attached state.

Referring to FIGS. 3 and 8, the first seal member 400 of the present embodiment is made of elastic insulating material such as rubber. The first seal member 400 has a substantially race track shape when viewed along the front-rear direction. In the perpendicular plane perpendicular to the front-rear direction, the first seal member 400 has the substantially race track shape which extends long in the right-left direction. The first seal member 400 is positioned forward of the rear surface 310 of the cap 300 in the front-rear direction. The first seal member 400 is positioned outward beyond the tube portion 320 of the cap 300 in a perpendicular direction perpendicular to the front-rear direction. The first seal member 400 surrounds the tube portion 320 of the cap 300 in the perpendicular plane. The first seal member 400 is brought into close contact with the tube portion 320 in the perpendicular direction. The first seal member 400 is positioned rearward of the held portion 510 of the conductive member 500 in the front-rear direction under the attached state where the cap 300 is attached to the surrounding portion 220. The first seal member 400 is positioned rearward of the frangible portion 532 in the front-rear direction under the attached state. The first seal member 400 is positioned inward beyond the surrounding portion 220 in the perpendicular direction under the attached state. The first seal member 400 is brought into close contact with the surrounding portion 220 in the perpendicular direction under the attached state. The first seal member 400 is interposed between the cap 300 and the surrounding portion 220. In other words, the first seal member 400 provides a waterproof seal (seal) between the cap 300 and the surrounding portion 220.

Referring to FIG. 3, the second seal member 570 of the present embodiment is made of elastic insulating material such as rubber. The second seal member 570 is positioned around a front end of the holding member 200 in the front-rear direction. The second seal member 570 is positioned forward of the contact target portion 700 in the front-rear direction. The second seal member 570 is brought into close contact with the holding member 200 in the perpendicular direction. The second seal member 570 is brought into close contact with the cable 800 in the perpendicular direction. The second seal member 570 is interposed between the holding member 200 and the cable 800 and between the cables 800. In other words, the second seal member 570 provides a waterproof seal between the holding member 200 and the cable 800 and between the cables 800.

As understood from FIGS. 3, 7 and 8, a conductive segment, which consists of the contact target portions 700 and the conductive member 500, is waterproofed from the outsides of the holding member 200 and the cap 300 under the attached state where the cap 300 is attached to the surrounding portion 220.

The structure of the conductive member 500 is not limited to the aforementioned one. For example, the conductive member 500 can be modified as described below.

Figure 12:
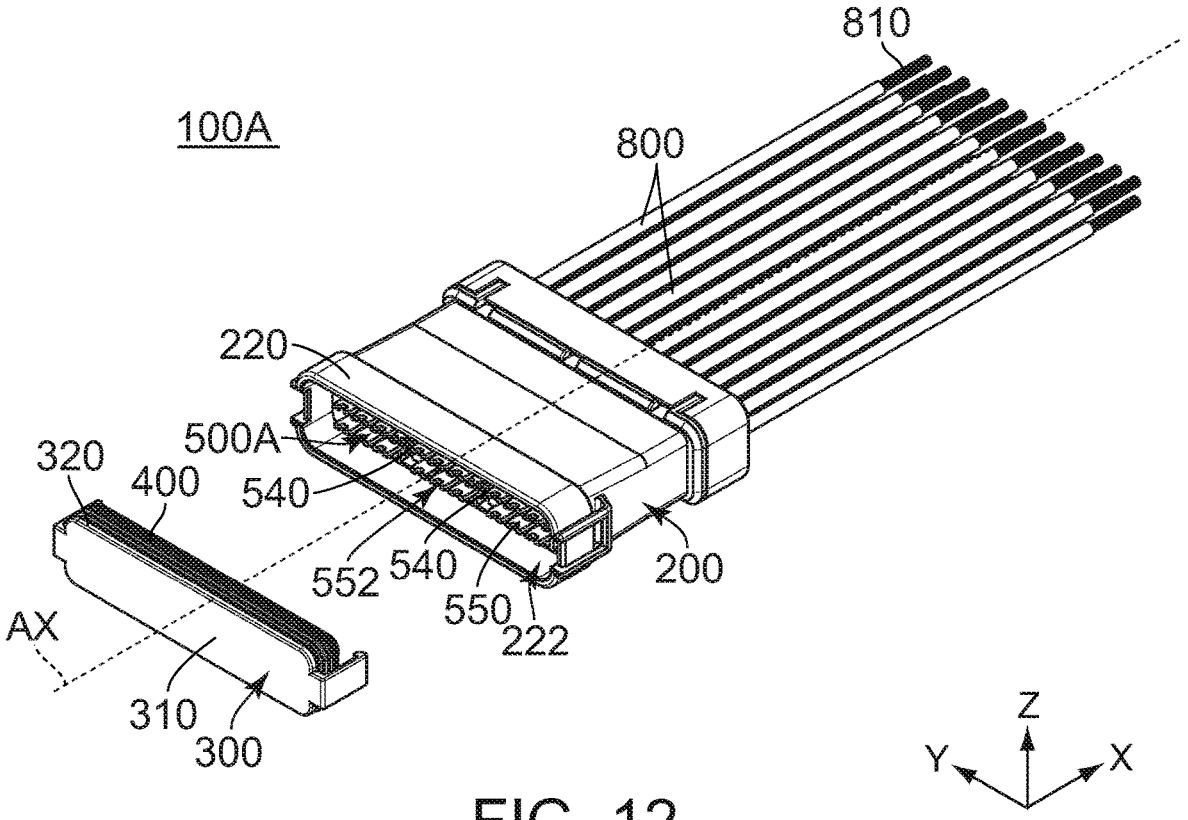
FIG. 12 is a perspective view showing a modification of the connecting apparatus of FIG. 2. In the figure, several of coupling portions are separated from the conductive member.
Figure 15:
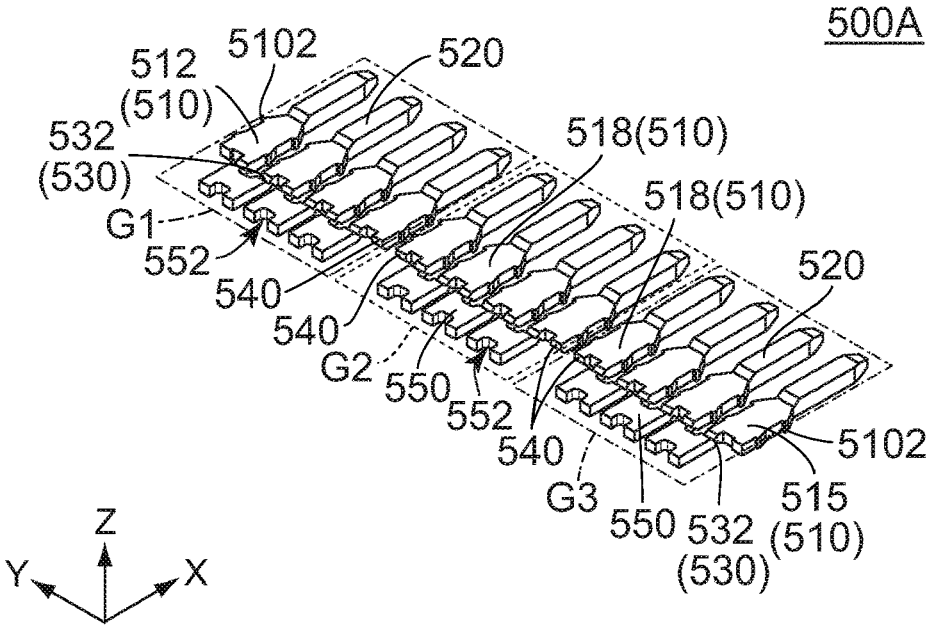
FIG. 15 is a perspective view showing a conductive member which is included in the connecting apparatus of FIG. 12.

Referring to FIGS. 12 and 15, a conductive member 500A of a connecting apparatus 100A of a modification has a plurality of held portions 510, a plurality of contact portions 520, a plurality of extending portions 530, a plurality of remaining extending portions 540 and a plurality of coupling portions 550. However, the present invention is not limited thereto. The conductive member 500A may be modified, provided that the conductive member 500A has the held portions 510, the contact portions 520, the extending portions 530, two of the remaining extending portions 540 and the coupling portions 550. In other words, the coupling portion 550 may be modified, provided that at least one of the coupling portions 550 and parts of two of the extending portions 530 are removed by splitting each of the two extending portions 530, which are coupled by the coupling portion 550, into two parts which are separated from each other in the front-rear direction. The conductive member 500A of the present modification can be achieved by snapping off at least one of the coupling portions 550 from the conductive member 500A under a state shown in FIG. 2 where the cap 300 is removed from the surrounding portion 220. Thus, the conductive member 500A can make any combination of connections between the contact portions 520 before the cables 800 are connected with the conductive member 500A through the contact target portions 700. Similarly, the conductive member 500A can also make any combination of connections between the contact portions 520 after the cables 800 are connected with the conductive member 500A through the contact target portions 700.

As shown in FIG. 15, the held portions 510 of the present modification are grouped into a plurality of groups which are arranged in the right-left direction and which include at least a first group G1 and a second group G2. In other words, the conductive member 500A of the present modification has at least the held portions 510, which are included in the first group G1, and the held portions 510 included in the second group G2. More specifically, the held portions 510 are grouped into three groups, namely, the first group G1, the second group G2 and a third group G3 which are arranged in the right-left direction.

As shown in FIG. 15, the first group G1 and the second group G2 are adjacent to each other in the right-left direction. More specifically, the first group G1 is adjacent to a left side of the second group G2 in the right-left direction. The second group G2 and the third group G3 are adjacent to each other in the right-left direction. More specifically, the second group G2 is adjacent to a left side of the third group G3 in the right-left direction.

Figure 11:
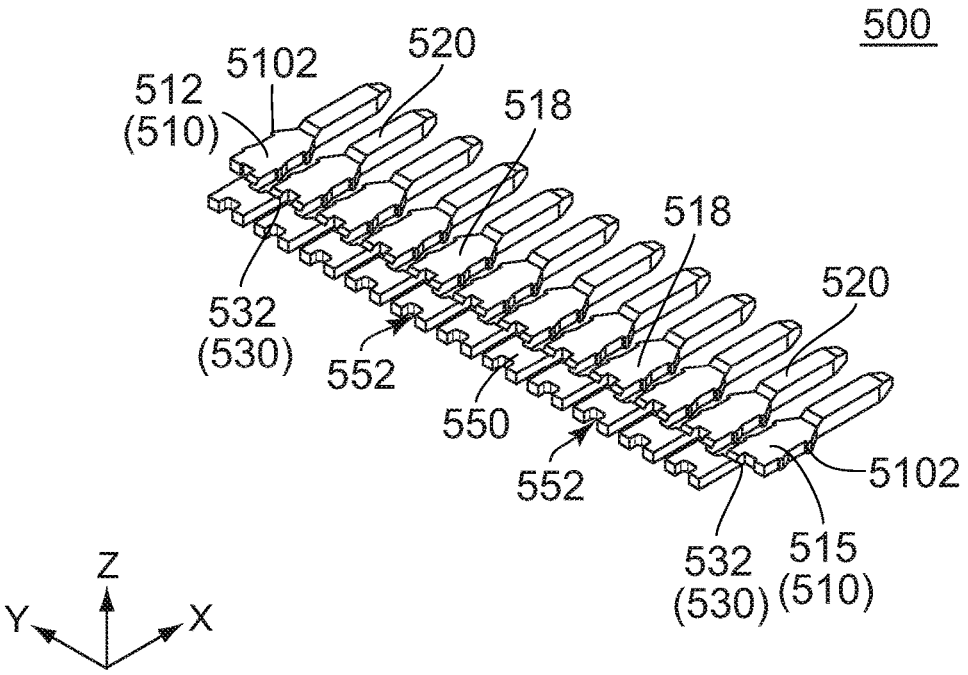
FIG. 11 is a perspective view showing the conductive member of FIG. 9.

As understood from FIGS. 11 and 15, the remaining extending portion 540 of the present modification is produced by snapping off the coupling portion 550 from the conductive member 500 by using a tool. In addition, the remaining extending portion 540 of the present modification is formed from the extending portion 530 which had been coupled with the snapped-off coupling portion 550. In other words, each of the remaining extending portions 540 is one of the two parts into which the extending portion 530 was separated in the front-rear direction. Accordingly, in the front-rear direction, each of the remaining extending portions 540 has a size smaller than that of the extending portion 530. A rear end of the remaining extending portion 540 is a split face produced by splitting the extending portion 530 by a tool at the frangible portion 532 into the two parts which are separated from each other in the front-rear direction.

As shown in FIG. 15, in the conductive member 500A of the present modification, the first group G1 includes one of the remaining extending portions 540. The remaining extending portion 540 of the first group G1 extends rearward in the front-rear direction from the held portion 510 of the first group G1 which is closest to the second group G2 among the held portions 510 of the first group G1. The second group G2 includes two of the remaining extending portions 540. One of the remaining extending portions 540 of the second group G2 extends rearward in the front-rear direction from the held portion 510 of the second group G2 which is closest to the first group G1 among the held portions 510 of the second group G2. A remaining one of the remaining extending portions 540 of the second group G2 extends rearward in the front-rear direction from the held portion 510 of the second group G2 which is closest to the third group G3 among the held portions 510 of the second group G2. The third group G3 includes one of the remaining extending portions 540. The remaining extending portion 540 of the third group G3 extends rearward in the front-rear direction from the held portion 510 of the third group G3 which is closest to the second group G2 among the held portions 510 of the third group G3. However, the present invention is not limited thereto. The conductive member 500A may be modified, provided that the conductive member 500A is configured as follows. The conductive member 500A comprises two of the remaining extending portions 540. The held portions 510 are grouped into two groups, namely, a first group G1 and a second group G2 which are arranged in the right-left direction. One of the two remaining extending portions 540 extends rearward in the front-rear direction from the held portion 510 of the first group G1 which is closest to the second group G2 among the held portions 510 of the first group G1. A remaining one of the two remaining extending portions 540 extends rearward in the front-rear direction from the held portion 510 of the second group G2 which is closest to the first group G1 among the held portions 510 of the second group G2.

As understood from FIGS. 7, 8 and 15, the rear end of each of the remaining extending portions 540 of the present modification is surrounded by the surrounding portion 220 in the perpendicular plane. More specifically, the rear end of each of the remaining extending portions 540 is positioned in the surrounding portion 220. The rear end of each of the remaining extending portions 540 is exposed in the surrounding portion 220.

As understood from FIGS. 7, 8 and 15, the rear end of each of the remaining extending portions 540 of the present modification is surrounded by the tube portion 320 in the perpendicular plane under the attached state where the cap 300 is attached to the surrounding portion 220. More specifically, the rear end of each of the remaining extending portions 540 is positioned in the tube portion 320 under the attached state. The rear end of each of the remaining extending portions 540 is exposed in the tube portion 320 under the attached state.

As shown in FIG. 15, in each of the first group G1, the second group G2 and the third group G3 of the conductive member 500A of the present modification, each of the coupling portions 550 couples two of the extending portions 530 with each other, and two of the held portions 510 adjacent to each other in the right-left direction are coupled with the two extending portions 530, respectively. Thus, the held portions 510, which are included in the first group G1, are electrically connected with each other by the extending portions 530 and the coupling portions 550. Similarly, the held portions 510, which are included in the second group G2, are electrically connected with each other by the extending portions 530 and the coupling portions 550. Further, similarly, the held portions 510, which are included in the third group G3, are electrically connected with each other by the extending portions 530 and the coupling portions 550.

As shown in FIG. 15, each of the held portions 510 included in the first group G1 is electrically connected with none of the held portions 510 included in the second group G2. Each of the held portions 510 included in the first group G1 is electrically connected with none of the held portions 510 included in the third group G3. Each of the held portions 510 included in the second group G2 is electrically connected with none of the held portions 510 included in the third group G3.

Figure 13:
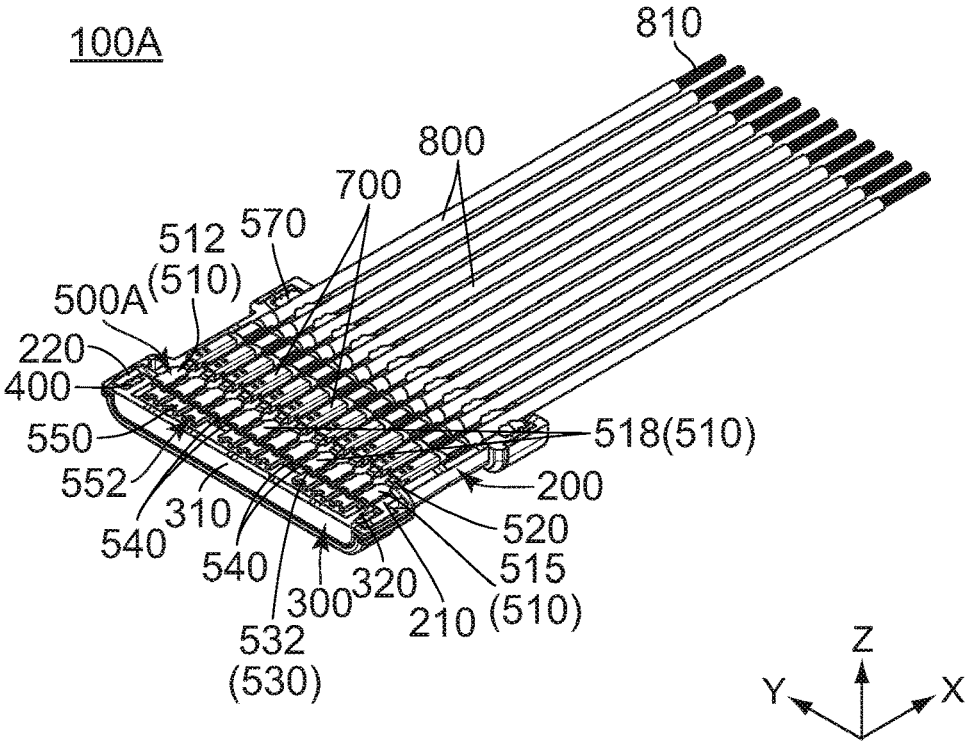
FIG. 13 is a partially cut-away, perspective view showing the connecting apparatus of FIG. 12. In the figure, a cap is attached to a surrounding portion of a holding member.
Figure 14:
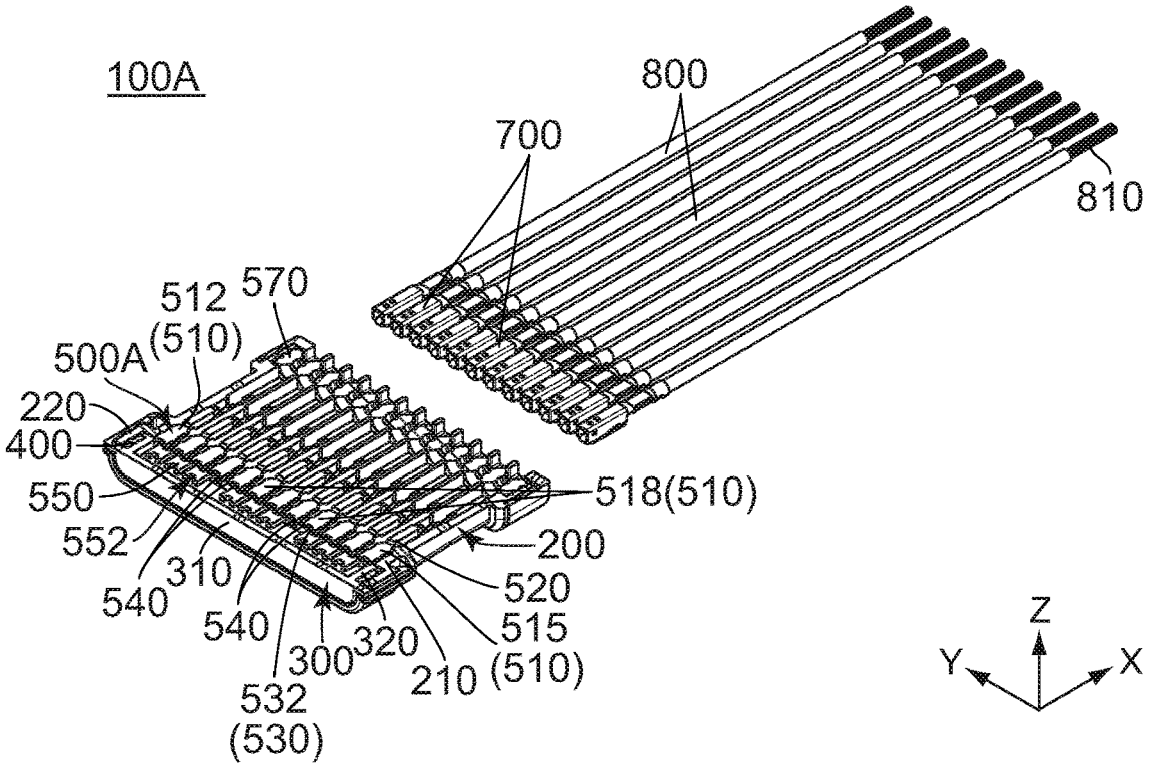
FIG. 14 is another partially cut-away, perspective view showing the connecting apparatus of FIG. 13. In the figure, contact target portions are not brought into contact with contact portions.

As understood from FIGS. 7, 8 and 13, a conductive segment, which consists of the contact target portions 700 and the conductive member 500A, is waterproofed from the outsides of the holding member 200 and the cap 300 under the attached state where the cap 300 is attached to the surrounding portion 220. The connecting apparatus 900 of Patent Document 1 has a drawback that broken faces of the conductive member 950, which are produced by the removal of the coupling portion 956, are exposed in the exposed hole 9122. On the contrary, such a drawback does not exist in the connecting apparatus 100A of the present modification. Thus, the conductive segment, in particular the remaining extending portion 540, is prevented from coming into contact with water droplets.

Second Embodiment

Figure 16:
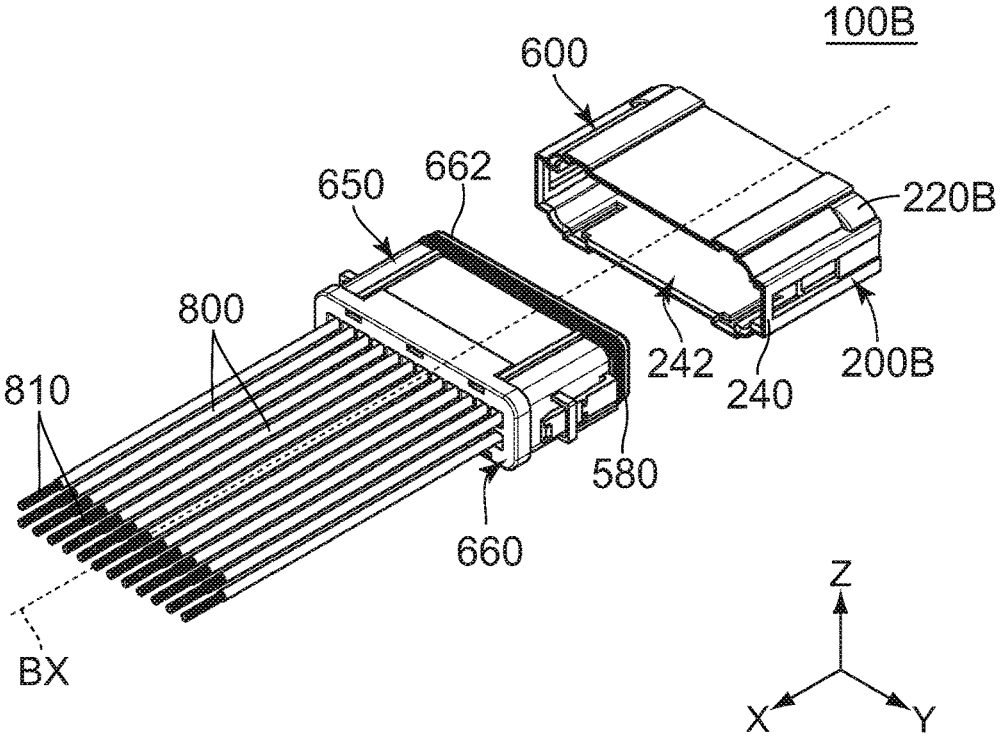
FIG. 16 is a perspective view showing a connecting apparatus according to a second embodiment of the present invention. In the figure, a first connector and a second connector are not connected with each other.

As shown in FIG. 16, a connecting apparatus 100B according to a second embodiment of the present invention has a first connector 600 and a second connector 650. As for directions and orientations in the present embodiment, expressions same as those of the first embodiment will be used hereinbelow.

Figure 17:
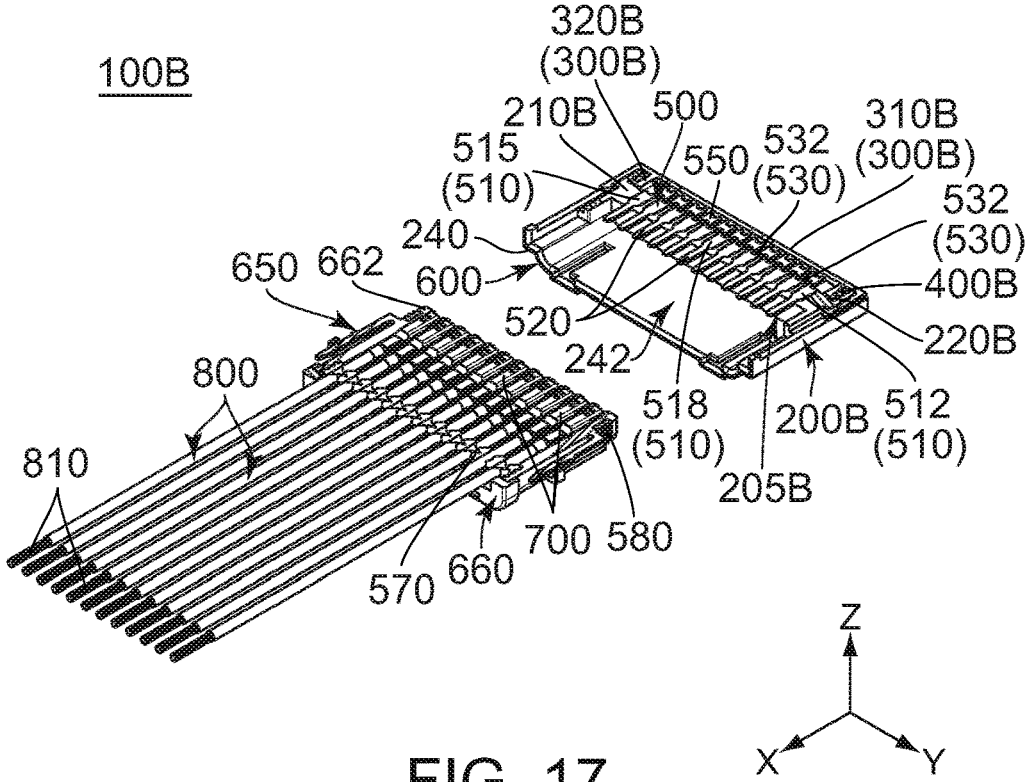
FIG. 17 is a partially cut-away, perspective view showing the connecting apparatus of FIG. 16.

As shown in FIG. 17, the first connector 600 of the present embodiment comprises a first holding member (holding member) 200B and a conductive member 500. The conductive member 500 is held by the first holding member 200B. In other words, the connecting apparatus 100B comprises the first holding member (holding member) 200B and the conductive member 500 which is held by the first holding member 200B.

Referring to FIG. 17, the first holding member 200B of the present embodiment is made of insulator. The first holding member 200B has a plurality of accommodating holes 205B, a surrounding portion 220B and a mating portion 240.

Figure 18:
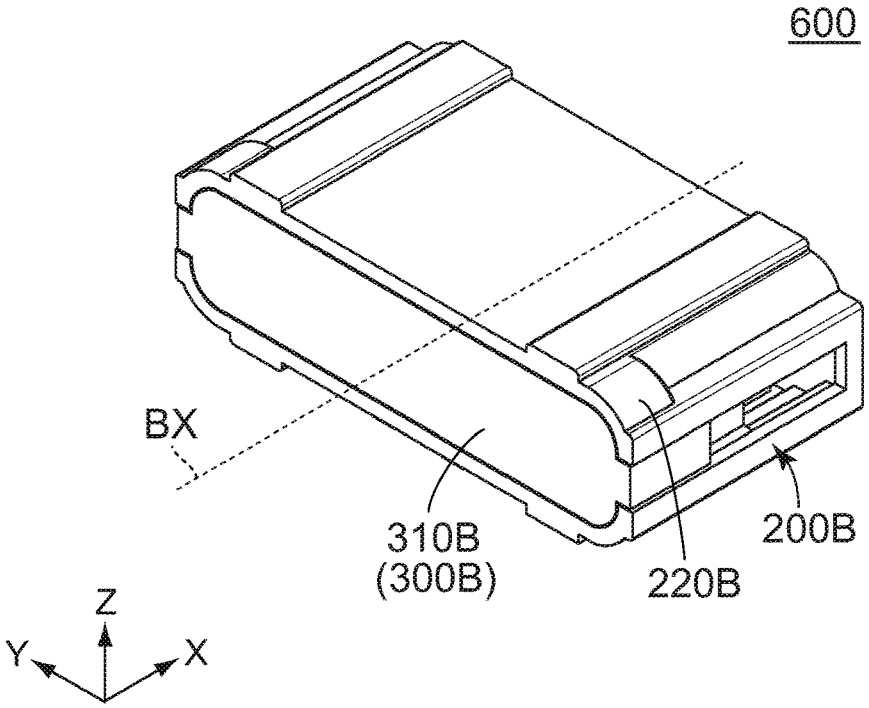
FIG. 18 is a perspective view showing the first connector which is included in the connecting apparatus of FIG. 16. In the figure, a cap is attached to a surrounding portion of a first holding member.

Referring to FIG. 17, each of the accommodating holes 205B of the present embodiment pierces the first holding member 200B in the front-rear direction. Each of the accommodating holes 205B is positioned forward of the surrounding portion 220B in the front-rear direction. More specifically, the accommodating holes 205B are grouped into two rows which are arranged in the up-down direction. The accommodating holes 205B of each row are arranged in the right-left direction. The accommodating holes 205B are arranged so as to be rotationally symmetric about an axis BX (see FIG. 18) extending in the front-rear direction.

As shown in FIG. 17, each of the accommodating holes 205B of the present embodiment has a first holding portion (holding portion) 210B. In other words, the first holding member (holding member) 200B of the present embodiment has the holding portions 210B.

As shown in FIG. 17, the first holding portion 210B of the present embodiment is a set of opposite inner surfaces of the accommodating hole 205B in the right-left direction. The first holding portion 210B is positioned forward of the surrounding portion 220B in the front-rear direction.

Figure 19:
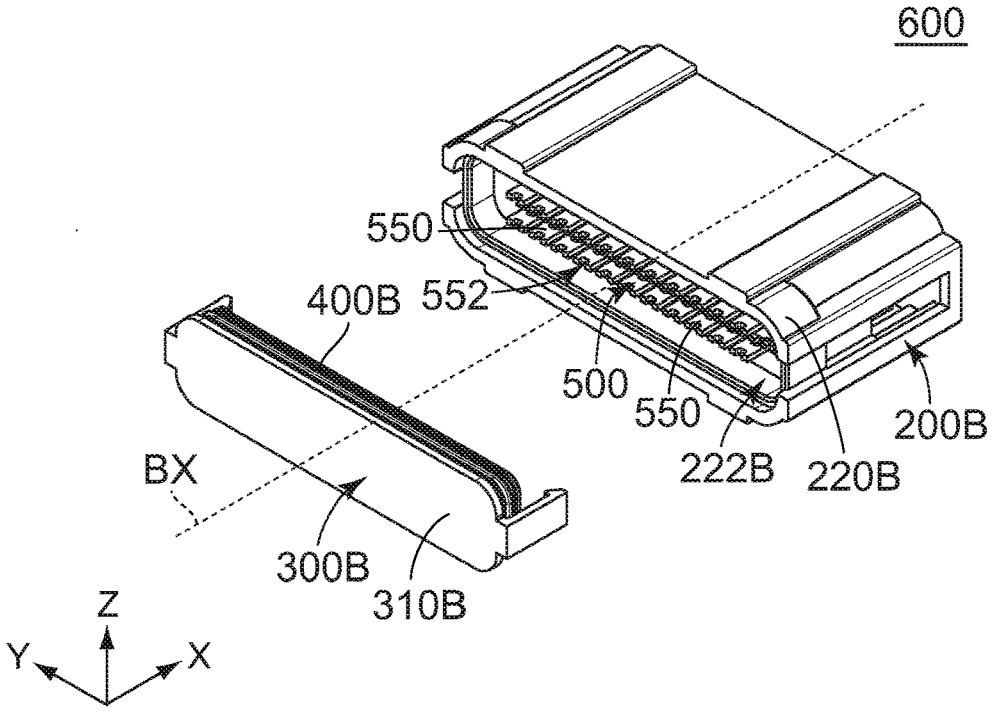
FIG. 19 is another perspective view showing the first connector of FIG. 18. In the figure, the cap is removed from the surrounding portion of the first holding member.

As understood from FIG. 19, the surrounding portion 220B of the present embodiment extends in the front-rear direction. The surrounding portion 220B defines a rear end of the first holding member 200B. A rear end of the surrounding portion 220B is opened. In other words, the surrounding portion 220B has an opening 222B at its rear end. The surrounding portion 220B has a shape which is rotationally symmetric about the axis BX extending in the front-rear direction. The surrounding portion 220B has a substantially race track shape when viewed from its rear. In a perpendicular plane perpendicular to the front-rear direction, the surrounding portion 220B has the substantially race track shape which extends long in the right-left direction.

As shown in FIG. 17, the mating portion 240 of the present embodiment is positioned forward of any of the accommodating holes 205B in the front-rear direction. A front end of the mating portion 240 is opened. Contact portions 520 of the conductive member 500 are surrounded by the mating portion 240 in the perpendicular plane. The front end of the mating portion 240 is positioned forward beyond a front end of any of the contact portions 520 of the conductive member 500 in the front-rear direction. The mating portion 240 has a contact target portion accommodating portion 242.

As shown in FIG. 17, the contact target portion accommodating portion 242 of the present embodiment is a space extending in the front-rear direction. The contact target portion accommodating portion 242 communicates with each of the accommodating holes 205B in the front-rear direction. Each of the contact portions 520 of the conductive member 500 is positioned in the contact target portion accommodating portion 242. Each of the contact portions 520 is exposed in the contact target portion accommodating portion 242.

As shown in FIG. 17, the conductive member 500 of the present embodiment has a plurality of held portions 510, the contact portions 520, a plurality of extending portions 530 and a plurality of coupling portions 550. The conductive member 500 of the present embodiment has a structure same as that of the conductive member 500 of the first embodiment. Accordingly, a detailed explanation thereabout is omitted.

As understood from FIG. 17, a part of each of the extending portions 530 of the present embodiment is surrounded by the surrounding portion 220B in the perpendicular plane. More specifically, the part of each of the extending portions 530 is positioned in the surrounding portion 220B. The part of each of the extending portions 530 is exposed in the surrounding portion 220B.

As understood from FIG. 17, a frangible portion 532 of the present embodiment is surrounded by the surrounding portion 220B in the perpendicular plane. More specifically, the frangible portion 532 is positioned in the surrounding portion 220B. The frangible portion 532 is exposed in the surrounding portion 220B.

As understood from FIG. 17, each of the coupling portions 550 of the present embodiment is surrounded by the surrounding portion 220B in the perpendicular plane. More specifically, each of the coupling portions 550 is positioned in the surrounding portion 220B. Each of the coupling portions 550 is exposed in the surrounding portion 220B.

As shown in FIG. 17, the first connector 600 of the present embodiment further comprises a cap 300B and a first seal member (seal member) 400B.

As understood from FIG. 19, the cap 300B of the present embodiment has a shape which is rotationally symmetric about the axis BX extending in the front-rear direction. As shown in FIG. 17, the cap 300B is closed at its rear end and is opened at its front end. More specifically, the cap 300B has a rear surface 310B and a tube portion 320B. The rear surface 310B defines the rear end of the cap 300B. The tube portion 320B is positioned forward of the rear surface 310B. The tube portion 320B is coupled with a front end of the rear surface 310B. The tube portion 320B has a substantially race track shape when viewed along the front-rear direction. In the perpendicular plane perpendicular to the front-rear direction, the tube portion 320B has the substantially race track shape which extends long in the right-left direction.

As shown in FIG. 17, the cap 300B is positioned at the rear end of the first connector 600 in the front-rear direction. The cap 300B is attached to the surrounding portion 220B. The cap 300B seals the opening 222B (see FIG. 19) of the surrounding portion 220B.

As understood from FIG. 17, a part of each of the extending portions 530 is surrounded by the tube portion 320B in the perpendicular plane under an attached state where the cap 300B is attached to the surrounding portion 220B. More specifically, the part of each of the extending portions 530 is positioned in the tube portion 320B under the attached state. The part of each of the extending portions 530 is exposed in the tube portion 320B under the attached state.

As understood from FIG. 17, the frangible portion 532 is surrounded by the tube portion 320B in the perpendicular plane under the attached state where the cap 300B is attached to the surrounding portion 220B. More specifically, the frangible portion 532 is positioned in the tube portion 320B under the attached state. The frangible portion 532 is exposed in the tube portion 320B under the attached state.

As understood from FIG. 17, each of the coupling portions 550 is surrounded by the tube portion 320B in the perpendicular plane under the attached state where the cap 300B is attached to the surrounding portion 220B. More specifically, each of the coupling portions 550 is positioned in the tube portion 320B under the attached state. Each of the coupling portions 550 is exposed in the tube portion 320B under the attached state.

Referring to FIG. 17, the first seal member 400B of the present embodiment is made of elastic insulating material such as rubber. The first seal member 400B has a substantially race track shape when viewed along the front-rear direction. In the perpendicular plane perpendicular to the front-rear direction, the first seal member 400B has the substantially race track shape which extends long in the right-left direction. The first seal member 400B is positioned forward of the rear surface 310B of the cap 300B in the front-rear direction. The first seal member 400B is positioned outward beyond the tube portion 320B of the cap 300B in the perpendicular direction. The first seal member 400B surrounds the tube portion 320B of the cap 300B in the perpendicular plane. The first seal member 400B is brought into close contact with the tube portion 320B in the perpendicular direction. The first seal member 400B is positioned rearward of any of the held portions 510 of the conductive member 500 in the front-rear direction under the attached state where the cap 300B is attached to the surrounding portion 220B. The first seal member 400B is positioned rearward of the frangible portion 532 in the front-rear direction under the attached state. The first seal member 400B is positioned inward beyond the surrounding portion 220B in the perpendicular direction under the attached state. The first seal member 400B is brought into close contact with the surrounding portion 220B in the perpendicular direction under the attached state. In other words, the first seal member (seal member) 400B is interposed between the cap 300B and the surrounding portion 220B. The first seal member 400B provides a waterproof seal between the cap 300B and the surrounding portion 220B.

In other words, the connecting apparatus 100B of the present embodiment further comprises the cap 300B, which is attached to the surrounding portion 220B, and the first seal member (seal member) 400B which is interposed between the cap 300B and the surrounding portion 220B.

As shown in FIG. 17, the second connector 650 of the present embodiment comprises a second holding member 660, a second seal member 570, a third seal member 580, contact target portions 700 and cables 800. The second seal member 570, the contact target portion 700 and the cable 800 have structures same as those of the first embodiment. Accordingly, a detailed explanation thereabout is omitted.

As shown in FIG. 17, the second holding member 660 of the present embodiment is distinct and separated from the first holding member 200B of the first connector 600. The second holding member 660 holds the contact target portions 700 and the cables 800. The second holding member 660 has a mated portion 662.

As shown in FIG. 17, the mated portion 662 of the present embodiment is positioned at a rear end of the second holding member 660 in the front-rear direction. The mated portion 662 has a substantially race track shape when viewed along the front-rear direction. In the perpendicular plane perpendicular to the front-rear direction, the mated portion 662 has the substantially race track shape which extends long in the right-left direction. The mated portion 662 surrounds the contact target portions 700 in the perpendicular plane. A rear end of the mated portion 662 is positioned rearward of a rear end of any of the contact target portions 700 in the front-rear direction.

Referring to FIG. 17, the third seal member 580 of the present embodiment is made of elastic insulating material such as rubber. The third seal member 580 has a substantially race track shape when viewed along the front-rear direction. In the perpendicular plane perpendicular to the front-rear direction, the third seal member 580 has the substantially race track shape which extends long in the right-left direction. The third seal member 580 is positioned rearward of any of the cables 800 in the front-rear direction. The third seal member 580 is positioned forward of the rear end of the mated portion 662 in the front-rear direction. The third seal member 580 is positioned outward beyond the mated portion 662 in the perpendicular direction. The third seal member 580 surrounds the mated portion 662 in the perpendicular plane. The third seal member 580 is brought into close contact with the mated portion 662 in the perpendicular direction.

As understood from FIGS. 16 and 17, the third seal member 580 is positioned inward beyond the mating portion 240 in the perpendicular direction under a mated state where the first connector 600 and the second connector 650 are mated with each other. The third seal member 580 is brought into close contact with the mating portion 240 in the perpendicular direction under the mated state. The third seal member 580 is interposed between the mating portion 240 and the mated portion 662 under the mated state. In other words, the third seal member 580 provides a waterproof seal between the mating portion 240 and the mated portion 662 under the mated state.

As understood from FIGS. 16 and 17, a conductive section, which consists of the contact target portions 700 and the conductive member 500, is waterproofed from the outsides of the first connector 600, the second connector 650 and the cap 300B under a state where the second connector 650 is mated with the first connector 600 whose cap 300B is attached to the surrounding portion 220B.

The structure of the conductive member 500 is not limited to the aforementioned one. For example, the conductive member 500 can be modified as described below.

Referring to FIG. 15, a conductive member (not shown) of a connecting apparatus of a modification has a plurality of held portions 510, a plurality of contact portions 520, a plurality of extending portions 530, a plurality of remaining extending portions 540 and a plurality of coupling portions 550. Specifically, the conductive member of the present modification is configured so that at least one of the coupling portions 550 and parts of two of the extending portions 530 are removed by splitting each of the two extending portions 530 into two parts which are separated from each other in the front-rear direction. However, the present invention is not limited thereto. The conductive member may be modified, provided that the conductive member has the held portions 510, the contact portions 520, the extending portions 530, two of the remaining extending portions 540 and the coupling portions 550. The conductive member of the present modification has a structure same as that of the conductive member 500A of the modification of the first embodiment. Accordingly, a detailed explanation thereabout is omitted.

Referring to FIGS. 15 and 17, a rear end of each of the remaining extending portions 540 of the present modification is surrounded by the surrounding portion 220B in the perpendicular plane. More specifically, the rear end of each of the remaining extending portions 540 is positioned in the surrounding portion 220B. The rear end of each of the remaining extending portions 540 is exposed in the surrounding portion 220B.

Referring to FIGS. 15 and 17, the rear end of each of the remaining extending portions 540 of the present modification is surrounded by the tube portion 320B in the perpendicular plane under the attached state where the cap 300B is attached to the surrounding portion 220B. More specifically, the rear end of each of the remaining extending portions 540 is positioned in the tube portion 320B under the attached state. The rear end of each of the remaining extending portions 540 is exposed in the tube portion 320B under the attached state.

Referring to FIGS. 15, 16 and 17, in the connecting apparatus of the present modification, a conductive segment, which consists of the contact target portions 700 and the conductive member, is waterproofed from the outsides of a first connector 600, the second connector 650 and the cap 300B under a state where the second connector 650 is mated with the first connector 600 whose cap 300B is attached to the surrounding portion 220B. The connecting apparatus 900 of Patent Document 1 has the drawback that the broken faces of the conductive member 950, which are produced by the removal of the coupling portion 956, are exposed in the exposed hole 9122. On the contrary, such a drawback does not exist in the connecting apparatus of the present modification. Accordingly, the conductive segment, in particular the remaining extending portion 540, is prevented from coming into contact with water droplets.

The structure of the connecting apparatus 100B is not limited to the aforementioned one. The connecting apparatus 100B may be modified as below.

Figure 20:
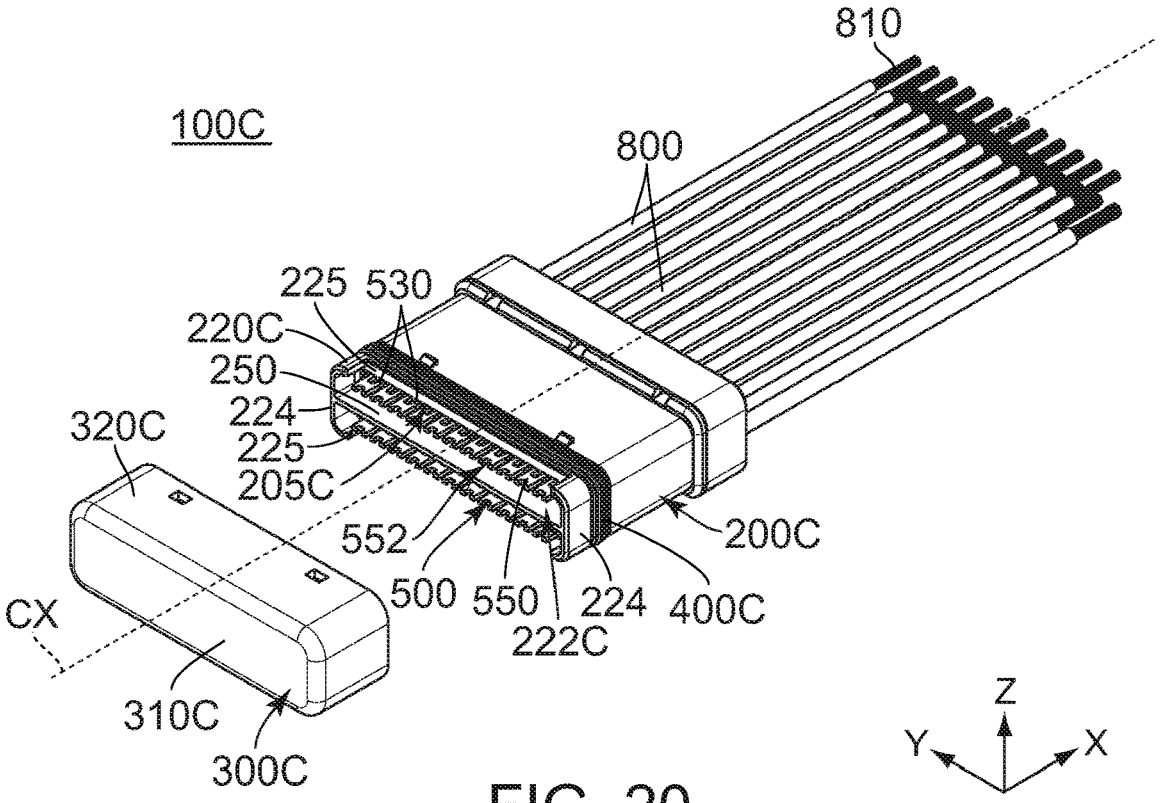
FIG. 20 is a perspective view showing a modification of the connecting apparatus of FIG. 16. In the figure, a cap is removed from a surrounding portion of a holding member.
Figure 21:
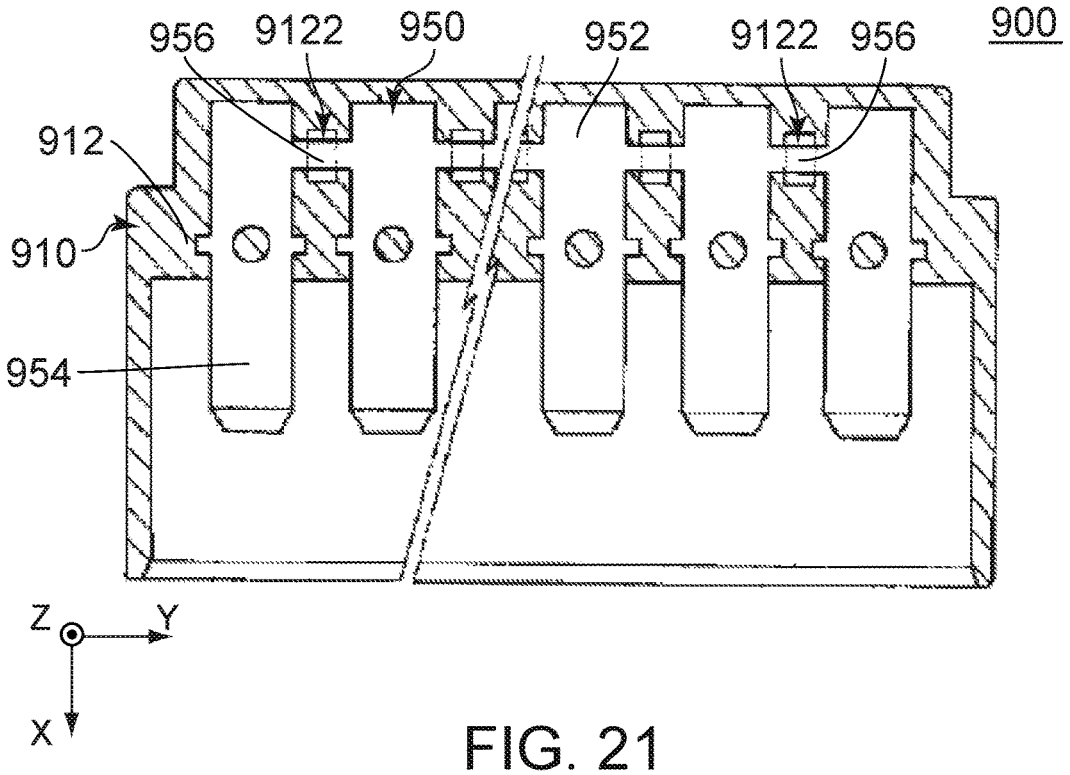
FIG. 21 PRIOR ART
FIG. 21 is a cross-sectional view showing a connecting apparatus of Patent Document 1.
Figure 22:
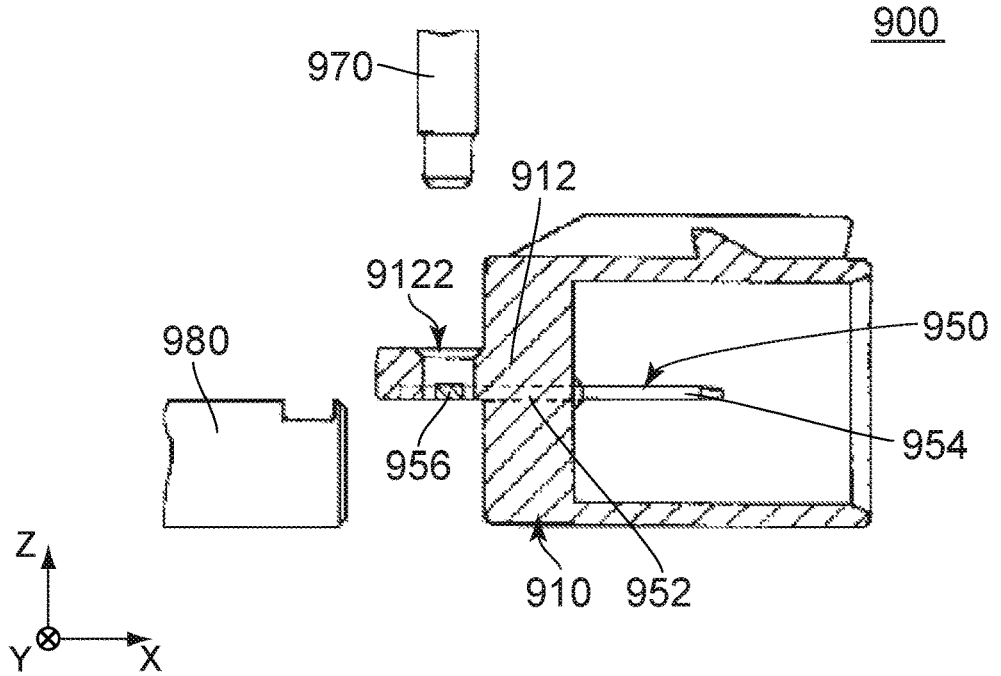
FIG. 22 PRIOR ART
FIG. 22 is another cross-sectional view showing the connecting apparatus of FIG. 21.

Referring to FIG. 20, a connecting apparatus 100C of a modification comprises a holding member 200C, a cap 300C, a first seal member (seal member) 400C, a second seal member 570, a conductive member 500, contact target portions 700 and a plurality of cables 800. The second seal member 570, the conductive member 500, the contact target portions 700 and the cables 800 of the present modification have structures same as those of the aforementioned embodiment. Accordingly, a detailed explanation thereabout is omitted.

Referring to FIG. 20, the holding member 200C of the present modification is made of insulator. The holding member 200C has a plurality of accommodating holes 205C, a surrounding portion 220C and a partition 250. The accommodating hole 205C of the present modification has a structure same as that of the accommodating hole 205 of the first embodiment. Accordingly, a detailed explanation thereabout is omitted.

As shown in FIG. 20, the surrounding portion 220C of the present modification extends in the front-rear direction. The surrounding portion 220C defines a rear end of the holding member 200C. A rear end of the surrounding portion 220C is opened. In other words, the surrounding portion 220C has an opening 222C at its rear end. The surrounding portion 220C has a shape which is rotationally symmetric about an axis CX extending in the front-rear direction.

As shown in FIG. 20, the surrounding portion 220C of the present modification has two side portions 224 and two cut-out portions 225.

As shown in FIG. 20, an upper end of the side portion 224 of the present modification is curved to extend inward in the right-left direction. A lower end of the side portion 224 is curved to extend inward in the right-left direction. The two side portions 224 are positioned at opposite ends, respectively, of the holding member 200C in the right-left direction. The side portion 224 defines the rear end of the holding member 200C in the front-rear direction. A rear end of each of the side portions 224 is positioned rearward in the front-rear direction beyond a rear end of a coupling portion 550. Under a state where the cap 300C is not attached to the surrounding portion 220C, the coupling portion 550 of the conductive member 500 is invisible from the outside of the connecting apparatus 100C in the right-left direction because the coupling portion 550 is hidden by the side portion 224. Under the state where the cap 300C is not attached to the surrounding portion 220C, the coupling portion 550 of the conductive member 500 is invisible from the right of the connecting apparatus 100C because the coupling portion 550 is hidden by the side portion 224. Under the state where the cap 300C is not attached to the surrounding portion 220C, the coupling portion 550 of the conductive member 500 is invisible from the left of the connecting apparatus 100C because the coupling portion 550 is hidden by the side portion 224. This prevents a tool from being unexpectedly brought into contact with the coupling portion 550 of the conductive member 500 in the right-left direction under the state where the cap 300C is not attached to the surrounding portion 220C.

As shown in FIG. 20, each of the cut-out portions 225 of the present modification is recessed forward in the front-rear direction. The two cut-out portions 225 are positioned at opposite ends, respectively, of the surrounding portions 220C in the up-down direction. Each of the cut-out portions 225 is positioned between the two side portions 224 in the right-left direction. The coupling portion 550 of the conductive member 500 is visible through the cut-out portion 225. Specifically, the coupling portion 550 of the conductive member 500 is visible along the up-down direction through the cut-out portion 225 under the state where the cap 300C is not attached to the surrounding portion 220C. The coupling portion 550 of the conductive member 500 is visible from above through the cut-out portion 225 under the state where the cap 300C is not attached to the surrounding portion 220C. The coupling portion 550 of the conductive member 500 is visible from below through the cut-out portion 225 under the state where the cap 300C is not attached to the surrounding portion 220C. This enables a user to hitch a tool to a concavity 552 from the outside of the connecting apparatus 100C in the up-down direction when the user snaps off the coupling portion 550.

As shown in FIG. 20, the partition 250 of the present modification has a flat-plate shape perpendicular to the up-down direction. The partition 250 defines the rear end of the holding member 200C in the front-rear direction. A rear end of the partition 250 is positioned rearward in the front-rear direction beyond the rear end of the coupling portion 550. The partition 250 is positioned between the two side portions 224 in the right-left direction. The two side portions 224 are positioned at opposite ends, respectively, of the partition 250 in the right-left direction. The two side portions 224 are coupled with the opposite ends, respectively, of the partition 250 in the right-left direction. In other words, the partition 250 is reinforced by the two side portions 224 and thereby the partition 250 is prevented from being curved in the up-down direction.

As understood from FIG. 20, the partition 250 is positioned between two rows of the accommodating holes 205C in the up-down direction. The partition 250 is positioned between two rows of held portions 510 in the up-down direction. The partition 250 is positioned between the coupling portion 550, which is coupled with the held portion 510 of an upper row of the two rows through an extending portion 530, and the coupling portion 550 which is coupled with the held portion 510 of a lower row of the two rows through the extending portion 530. This prevents a user from accidentally bringing a tool into contact with the coupling portion 550, which is coupled with the held portion 510 of the lower row through the extending portion 530, when the user snaps off, by using the tool, the coupling portion 550 which is coupled with the held portion 510 of the upper row through the extending portion 530. Similarly, this prevents a user from accidentally bringing a tool into contact with the coupling portion 550, which is coupled with the held portion 510 of the upper row through the extending portion 530, when the user snaps off, by using the tool, the coupling portion 550 which is coupled with the held portion 510 of the lower row through the extending portion 530.

As shown in FIG. 20, the cap 300C of the present modification has a shape which is rotationally symmetric about the axis CX extending in the front-rear direction. The cap 300C is closed at its rear end and is opened at its front end. More specifically, the cap 300C has a rear surface 310C and a tube portion 320C. The rear surface 310C defines the rear end of the cap 300C. The tube portion 320C is positioned forward of the rear surface 310C. The tube portion 320C is coupled with a front end of the rear surface 310C. The tube portion 320C has a substantially race track shape when viewed along the front-rear direction. In a perpendicular plane perpendicular to the front-rear direction, the tube portion 320C has the substantially race track shape which extends long in the right-left direction.

The cap 300C of the present modification is configured to be attached to the surrounding portion 220C. The cap 300C is positioned at a rear end of the connecting apparatus 100C in the front-rear direction under an attached state where the cap 300C is attached to the surrounding portion 220C. The cap 300C seals the opening 222C of the surrounding portion 220C under the attached state.

As described above, the rear end of each of the side portions 224 and the partition 250 is positioned rearward in the front-rear direction beyond the rear end of the coupling portion 550. Thus, when the cap 300C is attached to the surrounding portion 220C, the rear end of each of the side portions 224 and the partition 250 is brought into contact with the rear surface 310C of the cap 300C before the rear end of the coupling portion 550 is brought into contact with the rear surface 310C of the cap 300C. In other words, the side portions 224 and the partition 250 prevent the rear end of the coupling portion 550 from being brought into contact with the rear surface 310C of the cap 300C when the cap 300C is attached to the surrounding portion 220C.

As understood from FIG. 20, a part of the extending portion 530 faces a part of the tube portion 320C through the cut-out portion 225 in the up-down direction under the attached state.

As understood from FIG. 20, the coupling portion 550 faces a part of the tube portion 320C through the cut-out portion 225 in the up-down direction under the attached state.

As shown in FIG. 20, the first seal member (seal member) 400C of the present modification is made of elastic insulating material such as rubber. The first seal member 400C has a substantially race track shape when viewed along the front-rear direction. In the perpendicular plane perpendicular to the front-rear direction, the first seal member 400C has the substantially race track shape which extends long in the right-left direction. The first seal member 400C is positioned forward of the coupling portion 550 in the front-rear direction. The first seal member 400C is brought into close contact with the surrounding portion 220C in the perpendicular direction. The first seal member 400C is positioned forward in the front-rear direction beyond the rear surface 310C of the cap 300C. The first seal member 400C is positioned inward beyond the tube portion 320C of the cap 300C in the perpendicular direction perpendicular to the front-rear direction under the attached state. The first seal member 400C is surrounded by the tube portion 320C of the cap 300C in the perpendicular plane under the attached state. The first seal member 400C is brought into close contact with the tube portion 320C in the perpendicular direction under the attached state. The first seal member 400C is interposed between the cap 300C and the surrounding portion 220C under the attached state.

As understood from FIG. 20, the first seal member 400C provides a waterproof seal (seal) between the cap 300C and the surrounding portion 220C under the attached state. A conductive segment, which consists of the contact target portions 700 and the conductive member 500, is waterproofed from the outsides of the holding member 200C and the cap 300C under the attached state.

The structure of the conductive member 500 is not limited to the aforementioned one. For example, the conductive member 500 may be modified as below.

Referring to FIG. 15, a conductive member (not shown) of a connecting apparatus (not shown) of a modification comprises a plurality of held portions 510, a plurality of contact portions 520, a plurality of extending portions 530, a plurality of remaining extending portions 540 and a plurality of coupling portions 550. Specifically, the conductive member of the present modification is configured so that at least one of the coupling portions 550 and parts of two of the extending portions 530 are removed by splitting each of the two extending portions 530 into two parts which are separated from each other in the front-rear direction. However, the present invention is not limited thereto. The conductive member may be modified, provided that the conductive member comprises the held portions 510, the contact portions 520, the extending portions 530, two of the remaining extending portions 540 and the coupling portions 550. The conductive member of the present modification has a structure same as the conductive member 500A of the modification of the first embodiment. Accordingly, a detailed explanation thereabout is omitted.

Referring to FIGS. 15 and 20, the connecting apparatus of the present modification is configured so that a conductive segment, which consists of contact target portions 700 and the conductive member, is waterproofed from the outsides of a holding member 200C and a cap 300C under an attached state where the cap 300C is attached to a surrounding portion 220C. The connecting apparatus 900 of Patent Document 1 has the drawback that broken faces of the conductive member 950, which are produced by the removal of the coupling portion 956, are exposed in the exposed hole 9122. On the contrary, such a drawback does not exist in the connecting apparatus of the present modification. Accordingly, the conductive segment, in particular the remaining extending portion 540, is prevented from coming into contact with water droplets.

Although the specific explanation about the present invention is made above referring to the embodiments, the present invention is not limited thereto and is susceptible to various modifications and alternative forms.

Although the connecting apparatus 100, 100A, 100B of the present embodiment is configured so that the first seal member 400, 400B is provided outside the tube portion 320, 320B of the cap 300, 300B in the perpendicular direction, the present invention is not limited thereto. Specifically, the first seal member 400, 400B may be provided inside the tube portion 320, 320B of the cap 300, 300B in the perpendicular direction. If the first seal member 400, 400B is provided inside the tube portion 320, 320B of the cap 300, 300B in the perpendicular direction as describe above, the first seal member 400 400B can securely provide a waterproof seal between the cap 300, 300B and the surrounding portion 220, 220B so long as the first seal member 400, 400B is interposed between the cap 300, 300B and the surrounding portion 220, 220B when the cap 300, 300B is attached to the surrounding portion 220, 220B.

The present application is based on a Japanese patent application of JP2018-244577 filed before the Japan Patent Office on Dec. 27, 2018, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST

100, 100A, 100B, 100C connecting apparatus
200, 200C holding member
200B first holding member (holding member)
205, 205B, 205C accommodating hole
210 holding portion
210B first holding portion (holding portion)
220, 220B, 220C surrounding portion
222, 222B, 222C opening
224 side portion
225 cut-out portion
240 mating portion
242 contact target portion accommodating portion
250 partition
300, 300B, 300C cap
310, 310B, 310C rear surface
320, 320B, 320C tube portion
400, 400B, 400C first seal member (seal member)
500, 500A conductive member
510 held portion
5102 press-fit protrusion
512 leftmost held portion
515 rightmost held portion
518 normal held portion
520 contact portion
530 extending portion
532 frangible portion (ditch)
540 remaining extending portion
550 coupling portion
552 concavity
570 second seal member
580 third seal member
600 first connector
650 second connector
660 second holding member
662 mated portion
700 contact target portion
800 cable
810 core wire
AX axis
BX axis
CX axis
G1 first group
G2 second group
G3 third group
P pitch
S size

The invention claimed is:

1. A connecting apparatus comprising a holding member and a conductive member; wherein:

the conductive member is held by the holding member;

the holding member has holding portions;

the conductive member has a plurality of held portions, a plurality of contact portions, a plurality of extending portions and a plurality of coupling portions;

the held portions are held by the holding portions, respectively, and are arranged in a right-left direction;

the contact portions correspond to the held portions, respectively;

each of the contact portions is positioned forward of the corresponding held portion in a front-rear direction perpendicular to the right-left direction;

each of the extending portions extends rearward in the front-rear direction from one of the held portions and protrudes rearward in the front-rear direction beyond the holding portion;

the extending portions are positioned apart from each other in the right-left direction;

the coupling portions are positioned apart from each other in the right-left direction;

the coupling portions are positioned rearward of the extending portions in the front-rear direction;

each of the coupling portions couples two of the extending portions with each other; and two of the held portions, which are adjacent to each other in the right-left direction, are coupled with the two extending portions, respectively.

2. The connecting apparatus as recited in claim 1, wherein:

the held portions include a rightmost held portion, a leftmost held portion and at least one normal held portion;

the rightmost held portion is positioned at a rightmost end of the held portions in the right-left direction;

the leftmost held portion is positioned at a leftmost end of the held portion in the right-left direction;

the at least one normal held portion is positioned between the rightmost held portion and the leftmost held portion in the right-left direction;

one of the extending portions extends rearward in the front-rear direction from the rightmost held portion;

one of the extending portions extends rearward in the front-rear direction from the leftmost held portion; and two of the extending portions extend rearward in the front-rear direction from the at least one normal held portion.

3. The connecting apparatus recited in claim 1, wherein the holding member has a surrounding portion which surrounds the extending portions and the coupling portions in a plane perpendicular to the front-rear direction.

4. The connecting apparatus recited in claim 1, wherein;

the holding member has a surrounding portion;

the surrounding portion has two side portions and two cut-out portions; and the coupling portion is visible through the cut-out portion.

5. The connecting apparatus as recited in claim 4, wherein the holding member further has a partition;

the two side portions are positioned at opposite ends, respectively, of the holding member in the right-left direction; and the two side portions are coupled with opposite ends, respectively, of the partitions in the right-left direction.

6. The connecting apparatus as recited in claim 3, wherein:

the connecting apparatus further comprises a cap and a seal member;

the cap is attached to the surrounding portion; and the seal member is interposed between the cap and the surrounding portion.

7. The connecting apparatus as recited in claim 1, wherein:

the extending portion is provided with a frangible portion which has less strength; and the coupling portion is separable from the conductive member by splitting each of the two extending portions at the frangible portion into two parts which are separated from each other in the front-rear direction.

8. The connecting apparatus as recited in claim 7, wherein the frangible portion is a ditch extending in the right-left direction.

9. The connecting apparatus as recited in claim 1, wherein, in the right-left direction, a size of the coupling portion is smaller than a pitch between adjacent two of the contact portions.

10. The connecting apparatus as recited in claim 1, wherein at least one of the coupling portions and parts of the two extending portions are removed by splitting each of the two extending portions into two parts which are separated from each other in the front-rear direction.

* * * * *